US005290604A

United States Patent [19]

Nielsen

[11] Patent Number: 5,290,604

[45] Date of Patent: Mar. 1, 1994

[54] METHODS AND APPARATUS FOR SPRAYING SOLVENT-BORNE COMPOSITIONS WITH REDUCED SOLVENT EMISSION USING COMPRESSED FLUIDS AND SEPARATING SOLVENT

[75] Inventor: Kenneth A. Nielsen, Charleston, W. Va.

[73] Assignee: Union Carbide Chemicals & Plastics Technology Corporation, Danbury, Conn.

[21] Appl. No.: 993,355

[22] Filed: Dec. 18, 1992

[51] Int. Cl.[5] ..... B05D 1/02

[52] U.S. Cl. ..... 427/421; 427/422; 118/300

[58] Field of Search ..... 427/421, 422, 385.5, 427/426, 384; 118/300

[56] References Cited

U.S. PATENT DOCUMENTS

| | | | |
|---|---|---|---|
| 4,582,731 | 4/1986 | Smith | 427/421 |
| 4,734,227 | 3/1988 | Smith | 264/13 |
| 4,734,451 | 3/1988 | Smith | 524/493 |
| 4,923,720 | 5/1990 | Lee et al. | 427/422 |
| 5,009,367 | 4/1991 | Nielsen | 239/3 |
| 5,057,342 | 10/1991 | Hoy et al. | 427/422 |

*Primary Examiner*—Shrive Beck
*Assistant Examiner*—David M. Maiorana
*Attorney, Agent, or Firm*—J. F. Leightner

[57] ABSTRACT

A method and apparatus are provided for spraying a solvent-borne composition with reduced emission of organic solvents by exchanging a portion of the organic solvent diluent with a compressed fluid such as carbon dioxide, by adding the compressed fluid under pressure to maintain low viscosity and to facilitate solvent separation, separating a portion of the organic solvent, and spraying the resulting composition with compressed fluid.

19 Claims, 13 Drawing Sheets

EXAMPLE 1

EXAMPLES 2 & 3

METHODS AND APPARATUS FOR SPRAYING SOLVENT-BORNE COMPOSITIONS WITH REDUCED SOLVENT EMISSION USING COMPRESSED FLUIDS AND SEPARATING SOLVENT

FIELD OF THE INVENTION

This invention, in general, pertains to the field of spraying solvent-borne compositions with reduced emission of volatile organic solvent. More particularly, the present invention is directed to improved methods and apparatus for spraying solvent-borne compositions in which at least a portion of the organic solvent diluent is exchanged for a compressed fluid diluent such as carbon dioxide prior to spraying, by adding the compressed fluid to maintain low viscosity, separating at least a portion of the organic solvent, and spraying the resulting composition with compressed fluid, thereby reducing undesirable emission of organic solvent from the sprayed composition without having to manufacture, blend, pump, spray, or otherwise process the compositions in concentrate form with reduced solvent content and therefore high viscosity, increased reactivity, and lower stability.

BACKGROUND OF THE INVENTION

New spray technology has been developed for spraying compositions with markedly reduced solvent emissions by using environmentally acceptable supercritical fluids or subcritical compressed fluids such as carbon dioxide as a substitute for the solvent fraction in solvent-borne compositions that is needed to obtain low spray viscosity. For coating compositions, solvent reductions up to 80 percent have been demonstrated, because only enough solvent for film coalescence and leveling is used.

Supercritical fluid applications and properties are reviewed by K. Johnston in "Supercritical Fluids", Kirk-Othmer Encyclopedia of Chemical Technology, Wiley-Interscience, New York, 1984, and by M. A. McHugh and V. Krukonis in "Supercritical Fluid Extraction", Butterworths, Boston, 1986. An important property of supercritical fluids is that density, and hence solubility, can change markedly with small changes in pressure. Guckes et al. in U.S. Pat. No. 4,946,940 disclose a separation method in which methane is used as a phase separation agent to recover ethylene-propylene rubber from the hexane solvent reaction medium in which the solution polymerization process is carried out.

Although the supercritical fluid spray methods have been highly successful, one difficult problem that is created is that the reformulated composition, which is called a concentrate, has much higher viscosity after the dilution solvent is eliminated, typically 800 to 5000 centipoise or higher. Only when the concentrate is mixed with supercritical fluid is a low viscosity obtained. This makes manufacture, material handling and transfer, and other preparation operations, before the concentrate is sprayed, much more difficult than with conventional compositions that contain diluent solvents and have low viscosity, typically below 100 centipoise.

In addition to high viscosity, another difficult problem comes from concentrated reactive compositions, such as thermosetting systems or compositions with catalysts. The higher reactant concentration often significantly increases reactivity such that pot life becomes too short to spray the composition industrially.

Therefore, the ability to use additional solvent to manufacture, pump, meter, blend, mix, filter, and otherwise process concentrates at low viscosity like conventional compositions and to then separate the additional solvent just prior to spraying would be of great benefit.

There is therefore clearly a need to be able 1) to use excess diluent solvent for manufacturing, transporting, processing, and preparing compositions for spraying with supercritical fluids or subcritical compressed fluids, in order to avoid the problems created by viscous concentrates, and 2) to separate the excess diluent solvent just prior to spraying the composition, in order to minimize emissions of organic solvents from the sprayed composition.

SUMMARY OF THE INVENTION

By virtue of the present invention, methods and apparatus have been discovered that are indeed able to accomplish the above noted objectives. Additional solvent can be used to manufacture, transfer, pump, meter, blend, mix, filter, and process solvent-borne compositions at low viscosity. Compressed fluid such as carbon dioxide is added to the solvent-borne composition, to maintain low viscosity, and the additional solvent is separated just prior to spraying the composition with the compressed fluid, thereby minimizing emission of organic solvent from the sprayed composition. The compressed fluid furthermore facilitates separation of the solvent by preventing the large increase in viscosity that removal of the solvent would otherwise cause. Still further, the solvent blend can be adjusted to give more favorable spraying performance, such as by increasing the proportion of slowly evaporating solvents needed for proper film formation and decreasing the proportion of fast evaporating solvents lost by evaporation in the spray.

In its broadest embodiment, the present invention is directed to a method for spraying a solvent-borne composition with reduced emission of organic solvent while maintaining low viscosity, said solvent-borne composition comprising:

(i) a nonvolatile materials fraction capable of being sprayed as a liquid solution or dispersion; and (ii) a solvent fraction containing at least one organic solvent in which said nonvolatile materials fraction is at least partially soluble or dispersible and at least in an amount which is sufficient to render the viscosity of said solvent-borne composition suitable for being transportable, which method comprises:

(a) forming a precursor liquid spray mixture in a closed system, said precursor liquid spray mixture comprising said solvent-borne composition and, in addition, (iii) at least one compressed fluid under sufficient pressure and at least in an amount which when added to said solvent-borne composition is sufficient to maintain said precursor liquid spray mixture transportable after at least a portion of said solvent fraction is separated in step (b), said compressed fluid being a gas at standard conditions of 0° Celsius temperature and one atmosphere pressure (STP);

(b) separating at least a portion of solvent fraction (ii) from said precursor liquid spray mixture to form a liquid spray mixture having less organic solvent than said precursor liquid spray mixture, and then (c) passing the thusly formed liquid spray mixture under pressure through an orifice to form a spray.

In a preferred embodiment, the compressed fluid (iii) is present in said precursor liquid spray mixture in sufficient amount and under sufficient pressure that said precursor liquid spray mixture comprises at least two fluid phases consisting of at least a liquid nonvolatile materials-rich phase and a liquid compressed fluid-rich phase, and said portion of solvent fraction (ii) is separated by mass transfer of at least a portion of solvent fraction (ii) from said liquid nonvolatile materials-rich phase into said liquid compressed fluid-rich phase and then at least a portion of said liquid compressed fluid-rich phase is physically separated from said precursor liquid spray mixture to form said liquid spray mixture having less organic solvent.

As used herein, the term "transportable" is meant to provide the solvent-borne composition, precursor liquid spray mixture, and liquid spray mixture with a sufficiently low viscosity such that they are capable of being facilely conveyed by flowing from one point to another by any means, such as by gravity flow, by pumping, by passing through a pine or a conduit, by passing through a filter, by passing through a packed bed, by passing through an orifice, being able to be sprayed, being able to readily form a liquid level, and the like. It is not meant to be merely taking the material and placing it into a container such that the conveyance of the container makes the material transportable.

As used herein, the terms "separating" and "separation" are understood to mean chemically separating or dividing by mass transfer a mixture of chemical components into two or more portions having different compositions, such as extraction, supercritical fluid extraction, absorption, adsorption, gas stripping, supercritical fluid stripping, distillation, membrane separation, and so forth, which are well known to those skilled in the art of chemical engineering. It is not meant to be merely mechanically or physically separating or dividing two or more phases by mechanical or physical means with no change in composition or in which a material is simply subdivided into segments.

In another embodiment the solvent-borne composition is a solvent-borne polymeric composition with the nonvolatile materials fraction containing at least one polymeric compound which is at least partially soluble in the solvent fraction. In a preferred embodiment, the solvent-born polymeric composition comprises a solvent-borne coating composition that contains at least one polymeric compound capable of forming a coating on a substrate. In another preferred embodiment, the compressed fluid comprises compressed carbon dioxide.

In still another preferred embodiment in which said solvent-borne composition is a solvent-borne polymeric composition, said portion of solvent fraction (ii) is separated by contacting said precursor liquid spray mixture with a microporous membrane and passing at least a portion of solvent fraction (ii) through said membrane.

In still another embodiment, the present invention is directed to a method of spraying a solvent-borne additives composition to a polymeric substrate prior to extrusion, filming, molding, or processing of the polymeric substrate with reduced emission of organic solvent while maintaining low viscosity, said solvent-borne additives composition comprising:

(i) a dispersed solid additives fraction containing at least one dispersible solid additive capable of being sprayed as a dispersion;

(ii) a polymer fraction containing at least one polymeric compound; and (iii) a solvent fraction containing at least one organic solvent in which said at least one polymeric compound is at least partially soluble and at least in an amount which is sufficient to render the viscosity of said solvent-borne additives composition suitable for being transportable, which method comprises:

(a) forming a precursor liquid spray mixture in a closed system, said precursor liquid spray mixture comprising said solvent-borne additives composition and, in addition, (iv) at least one compressed fluid under sufficient pressure and at least in an amount which when added to said solvent-borne additives composition is sufficient to maintain said precursor liquid spray mixture transportable after at least a portion of said solvent fraction is separated in step (b), said compressed fluid being a gas at standard conditions of 0° Celsius temperature and one atmosphere pressure (STP);

(b) separating at least a portion of solvent fraction (iii) from said precursor liquid spray mixture to form a liquid spray mixture having less organic solvent than said precursor liquid spray mixture, and then (c) passing the thusly formed liquid spray mixture under pressure through an orifice to form a spray and directing said spray at a polymeric substrate to deposit said additives thereon.

Here again, in a preferred embodiment, the compressed fluid (iv) is present in said precursor liquid spray mixture in sufficient amount and under sufficient pressure that said precursor liquid spray mixture comprises at least two fluid phases consisting of at least a liquid additives-rich phase and a liquid compressed fluid-rich phase, and said portion of solvent fraction (iii) is separated by mass transfer of at least a portion of solvent fraction (iii) from said liquid additives-rich phase into said liquid compressed fluid-rich phase and then at least a portion of said liquid compressed fluid-rich phase is physically separated from said precursor liquid spray mixture to form said liquid spray mixture having less organic solvent. In another preferred embodiment, the solvent fraction (iii) is substantially separated from the precursor liquid spray.

In yet another embodiment, the present invention is directed to an apparatus for spraying a solvent-borne composition with reduced emission of organic solvent while maintaining low viscosity, which comprises, in combination:

(a) means for supplying a solvent-borne composition containing at least one nonvolatile material capable of being sprayed as a liquid solution or dispersion and at least one organic solvent in which said nonvolatile material is at least partially soluble or dispersible and at least in an amount which is sufficient to render the viscosity of said solvent-borne composition suitable for being transportable;

(b) means for supplying at least one compressed fluid, said compressed fluid being a gas at standard conditions of 0° Celsius temperature and one atmosphere pressure (STP);

(c) means for forming under pressure in closed system a precursor liquid spray mixture of components supplied from (a) and (b);

(d) means for separating at least a portion of said at least one organic solvent from said precursor liquid spray mixture to form a liquid spray mixture having less organic solvent than said precursor liquid spray mixture; and (e) means for spraying said liquid spray mixture by passing said liquid spray mixture under pressure through an orifice to form a spray.

DETAILED DESCRIPTION OF THE INVENTION

Figure 1:
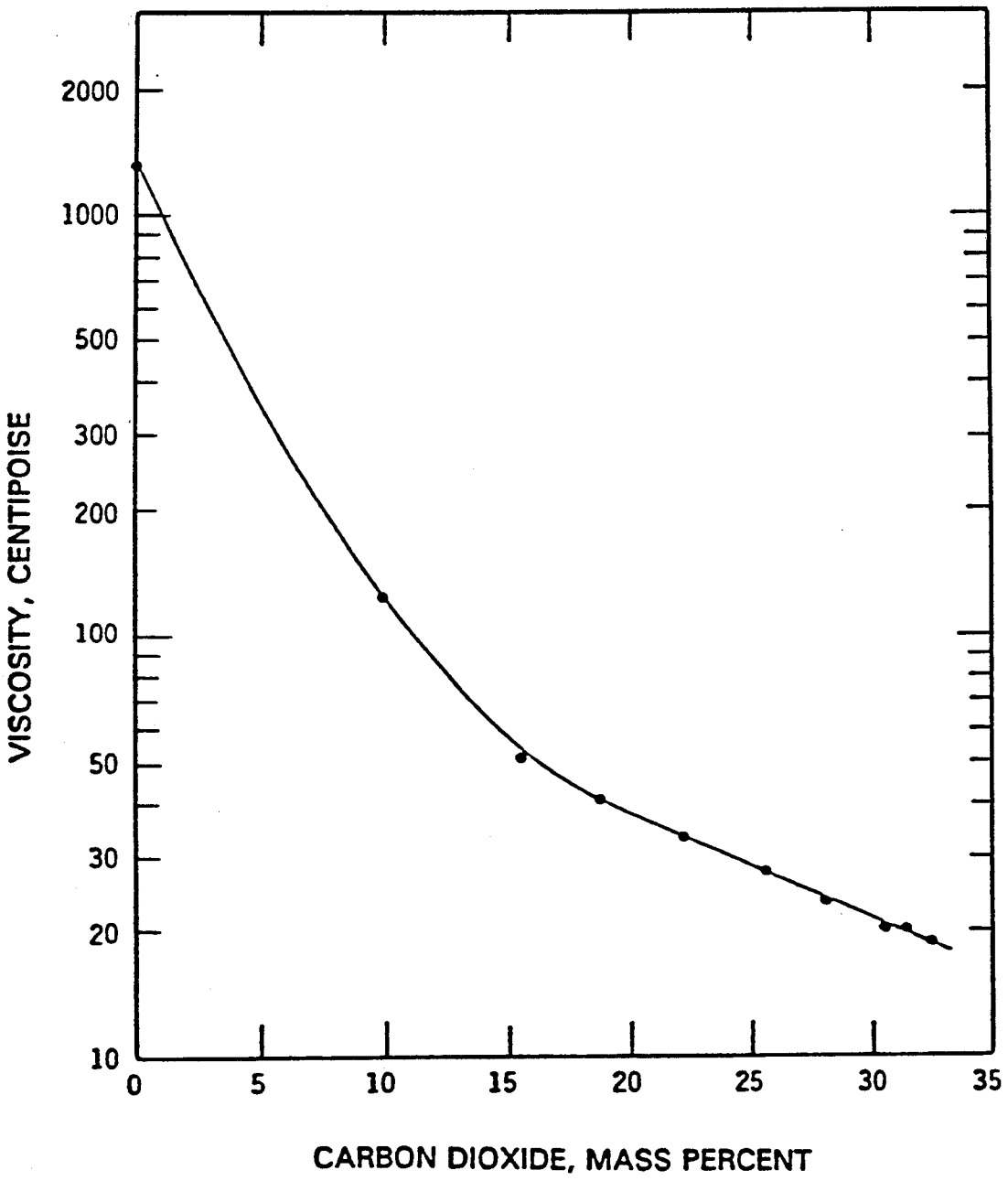
FIG. 1 is a diagram that illustrates viscosity reduction by dissolving compressed carbon dioxide into a viscous coating composition.

It has been found that, by using the methods and apparatus of the present invention, solvent-borne compositions to be sprayed with compressed fluids such as carbon dioxide can be manufactured, pumped, metered, blended, mixed, filtered, and otherwise processed at relatively high solvent levels that give low viscosity, thereby avoiding processing problems caused by low solvent levels and high viscosity, and then be sprayed at low solvent levels, thereby reducing organic solvent emissions that cause air pollution, substrate damage, and product contamination. This is accomplished by exchanging at least a portion of the organic solvent diluent with compressed fluid diluent prior to spraying the composition, by (i) adding the compressed fluid to the solvent-borne composition having a high solvent level, to maintain low viscosity until the composition is sprayed, (ii) separating at least a portion of the organic solvent from the resulting mixture, and (iii) passing the liquid spray mixture thus formed having less organic solvent under pressure through an orifice to form a spray.

As used herein, it will be understood that a "compressed fluid" is a fluid which may be in its gaseous state, its liquid state, or a combination thereof, or is a supercritical fluid, depending upon (i) the particular temperature and pressure to which it is subjected upon admixture with the solvent-borne composition that is to be sprayed, (ii) the vapor pressure of the fluid at that particular temperature, and (iii) the critical temperature and critical pressure of the fluid, but which is in its gaseous state at standard conditions of 0° Celsius temperature and one atmosphere absolute pressure (STP). As used herein, a "supercritical fluid" is a material that is at a temperature and pressure such that it is at, above, or slightly below its critical point.

As used herein, the phrase "solvent-borne composition" is understood to mean conventional liquid solvent-borne compositions, materials, dispersions, and formulations that have no compressed fluid admixed therewith. As also used herein, the phrases "coating composition", "coating material", and "coating formulation" are understood to mean liquid compositions comprising conventional coating compositions, materials, and formulations that have no compressed fluid admixed therewith.

As used herein, the term "solvent" is understood to mean conventional organic solvents that have no compressed fluid admixed therewith and which are in the liquid state at conditions of about 25° Celsius temperature and one atmosphere absolute pressure.

As used herein, the phrase "precursor liquid spray mixture" is understood to mean an admixture of a solvent-borne composition with at least one compressed fluid. As also used herein, the phrases "liquid spray mixture" and "spray mixture" are understood to mean a precursor liquid spray mixture from which at least a portion of solvent has been separated after admixture with at least one compressed fluid and prior to being sprayed.

Compounds which may be used as compressed fluids in the present invention include but are not limited to carbon dioxide, nitrous oxide, ammonia, xenon, ethane, ethylene, propane, propylene, butane, isobutane, chlorotrifluoromethane, monofluoromethane, and mixtures thereof.

Preferably, the compressed fluid has appreciable solubility in the solvent-borne composition and is environmentally compatible, can be made environmentally compatible by treatment, such as by thermal decomposition or incineration, or can be readily recovered from the spray environment, such as by absorption or adsorption. The utility of any of the above-mentioned compressed fluids in the practice of the present invention will depend upon the solvent-borne composition and solvents used, the temperature and pressure of application, and the inertness and stability of the compressed fluid.

Due to environmental compatibility, low toxicity, and high solubility, carbon dioxide, ethane, and nitrous oxide are preferred compressed fluids in the present invention. Due to low cost, non-flammability, stability, and wide availability, carbon dioxide is the most preferred compressed fluid.

The solvent-borne compositions that may be used with the present invention are generally comprised of 1) a nonvolatile materials fraction capable of being sprayed as a solution or a dispersion and 2) a solvent fraction in which the nonvolatile materials fraction is at least partially soluble or dispersible. Examples of solvent-borne compositions that may be used include coatings, adhesives, release agents, additives, gel coats, lubricants, non-aqueous detergents, agricultural materials such as herbicides and insecticides and the like.

The present invention is particularly useful for solvent-borne compositions which heretofore could not be sprayed or sprayed well, because the application requires little or no solvent be present in the spray, with the permitted solvent level being too low to achieve good atomization.

The nonvolatile materials fraction comprises materials such as polymers, resins, and waxes; nonvolatile organic compounds such as organic pigments, herbicides, insecticides, antioxidants, surfactants, ultraviolet absorbers, whiteners, and plasticizers; and other nonvolatile materials such as pigments, pigment extenders, fillers, decorative metallic flakes, abrasives, chemical agents, and glass fibers. As used herein it is understood that the phrase "nonvolatile materials fraction" includes solid materials and nonvolatile liquid materials such as liquid polymers and other high-molecular-weight compounds that are viscous liquids at a temperature of about 25° Celsius. In general, the nonvolatile materials fraction is the fraction of the solvent-borne composition that remains after the solvent fraction has evaporated from the solvent-borne composition.

In general, divided solids in the nonvolatile materials fraction that are dispersed in the solvent-borne composition should have particle sizes that are sufficiently small to maintain a dispersed state, that is, to prevent settling, and to pass readily through the spray orifice. Divided solids with particle sizes too large to maintain a stable dispersion may be used if a dispersion or suspension can be formed and maintained by agitation. Preferably, the nonvolatile materials fraction contains dispersed solids that have an average particle size less than about 25 microns and more preferably less than about 10 microns.

The present invention is particularly useful for solvent-borne compositions in which the nonvolatile materials fraction contains one or more polymeric compounds, such as coatings, adhesives, release agents, additive formulations, gel coats, and the like; or polymeric materials that are spray fabricated to form structural or composite materials, including films.

Coating compositions that may be used with the present invention typically include a nonvolatile materials fraction containing at least one component which is capable of forming a coating on a substrate, whether such component is an adhesive, a paint, lacquer, varnish, chemical agent, lubricant, protective oil, non-aqueous detergent, or the like. Typically, at least one component is a polymeric component which is well known to those skilled in the coatings art.

Generally, the nonvolatile materials fraction used in the solvent-borne compositions of the present invention, such as the polymers, must be able to withstand the temperatures and/or pressures to which they are subjected after they are ultimately admixed with the compressed fluid. Such applicable polymers include thermoplastic and thermosetting materials and may be cross-linkable film forming systems. The polymers may be liquid polymers or solid polymers and they may be dissolved or dispersed in the solvent.

In particular, the polymeric compounds include vinyl, acrylic, styrenic, and interpolymers of the base vinyl, acrylic, and styrenic monomers; polyesters, oil-free alkyds, alkyds, and the like; polyurethanes, oil-modified polyurethanes and thermoplastic urethanes systems; epoxy systems; phenolic systems; cellulosic esters such as acetate butyrate, acetate propionate, and nitrocellulose; amino resins such as urea formaldehyde, melamine formaldehyde, and other aminoplast polymers and resins materials; natural gums and resins; silicone polymers such as polydimethylsiloxane and related polymers; rubber-based adhesives including nitrile rubbers which are copolymers of unsaturated nitriles with dienes, styrene-butadiene rubbers, thermoplastic rubbers, neoprene or polychloroprene rubbers, and the like.

The nonvolatile materials fraction may contain conventional additives, such as dissolved or dispersed solids, that are typically utilized in coatings and other applications. For example, pigments, pigment extenders, metallic flakes, fillers, drying agents, anti-foaming agents, anti-skinning agents, wetting agents, ultraviolet absorbers, cross-linking agents, and mixtures thereof, may all be utilized in the solvent-borne coating compositions to be used with the methods of the present invention.

For the spray application of additives to polymeric substrates for polymer processing such as extrusion, the type of polymeric substrate is not critical. The polymeric substrate will generally be a thermoplastic polymer in pellet form, but other types of polymers and physical forms may be used, such as powders. Polymeric substrates that may be used include polyethylenes, polypropylenes, ethylene-propylene interpolymers, nylons, polyesters, acrylonitrile-butadiene-styrene terpolymers, cellulose acetates, polycarbonates, polymethylmethacrylates, polystyrenes, polyvinylchlorides, mixtures thereof, and the like. The type of polymer processing applied to the polymeric substrate after addition of the additives is also not critical and includes extrusion, filming, molding, blow molding, structural foaming, and other methods known to those skilled in the art. Polymeric compounds useful as additives or liquid polymer carriers for dispersed solids additives include functional silicones, polyalkylene glycols, polyalpha-olefins, mixtures thereof, and other polymers known to those skilled in the art. Dispersed solid additives include primary antioxidants including hindered phenols, secondary antioxidants including phosphites, neutralizer/metal deactivators, molecular sieves, slip agents, light stabilizers, antiblocks, colorants, lubricants, flame retardants, antistatic agents, and mixtures thereof.

In addition to the nonvolatile materials fraction, a solvent fraction is also employed in the solvent-borne compositions. The solvent may perform a variety of functions, such as to dissolve polymers and other components, to reduce viscosity, to provide a carrier medium for dispersions, to give proper flow characteristics, to dilute reactive compositions to retard or inhibit reactions, to prevent skinning, drying, precipitation, and gelation caused by solvent evaporation during storage, and the like. In other applications, such as the spray application of additives in polymer processing, the solvent fraction may be a processing aid added to facilitate blending additives that are viscous pastes and the like in different proportions on demand for different plastic products, and the object is to remove solvent that would contaminate the plastic product. As used herein, the solvent fraction is comprised of essentially any organic solvent or non-aqueous diluent which is at least partially miscible with the nonvolatile materials fraction so as to form a solution or dispersion. The selection of a particular solvent fraction for a given nonvolatile materials fraction in order to form, for example, a specific coating formulation for application by airless spray techniques is conventional and well known to those skilled in the art. In general, up to about 30 percent by weight of water, preferably up to about 20 percent by weight, may also be present in the solvent fraction provided that a coupling solvent is also present. All such solvent fractions are suitable in the present invention.

A coupling solvent is a solvent in which the nonvolatile materials such as polymers are at least partially soluble. Most importantly, however, such a coupling solvent is also at least partially miscible with water. Thus, the coupling solvent enables the miscibility of the nonvolatile materials fraction, the solvent fraction, and the water to the extent that a single liquid phase is desirably maintained such that the composition may optimally be sprayed and, for example, a good coating formed. Coupling solvents are well known to those skilled in the art and any conventional coupling solvents which are able to meet the aforementioned characteristics are suitable for being used in the present invention. Applicable coupling solvents include, but are not limited to, ethylene glycol ethers, propylene glycol ethers, and chemical and physical combinations thereof; lactams; cyclic ureas; and the like. When water is not present in the solvent-borne composition, a coupling solvent is not necessary, but may still be employed.

Other solvents which may be present in typical solvent-borne compositions, including coating compositions and the like, and which may be utilized in the present invention include ketones such as acetone, methyl ethyl ketone, methyl isobutyl ketone, methyl amyl ketone, cyclohexanone and other aliphatic ketones; esters such as methyl acetate, ethyl acetate, and other alkyl carboxylic esters; ethers, such as methyl t-butyl ether, dibutyl ether, methyl phenyl ether and other aliphatic or alkyl aromatic ethers; glycol ethers such as ethoxy ethanol, butoxy ethanol, ethoxy 2-propanol, propoxy ethanol, butoxy 2-propanol and other glycol ethers; glycol ether esters such as butoxy ethoxy acetate, ethyl 3-ethoxy propionate and other glycol ether esters; alcohols such as methanol, ethanol, propanol, butanol, amyl alcohol and other aliphatic alcohols; aromatic hydrocarbons such as toluene, xylene, and other aromatics or mixtures of aromatic solvents; aliphatic hydrocarbons such as VM&P naphtha and mineral spirits, and other aliphatics or mixtures of aliphatics; and nitroalkanes such as 2-nitropropane. By adding compressed fluid to the solvent-borne composition before or as the undesired solvent is separated, a low viscosity is maintained as solvent is separated and until the composition is sprayed. In fact, as the solvent is separated, the viscosity can be significantly lower than the initial viscosity and the final spray viscosity, due to the combined viscosity reduction actions of the compressed fluid and undesired solvent. Therefore mixing, phase separation, and other transport operations utilized by the separation procedure can be readily achieved.

Viscosity reduction brought about by dissolving compressed carbon dioxide into a viscous coatings composition is illustration in FIG. 1. The composition contains an acrylic polymer with a molecular weight of about 6,000 that is dissolved in methyl amyl ketone solvent. A concentrate with 75 percent polymer has a viscosity of 1340 centipoise (25° Celsius). Adding carbon dioxide to 30 weight percent concentration reduces the viscosity to below 25 centipoise.

Preferably, the transportable viscosity of the precursor liquid spray mixture and the liquid spray mixture each are maintained less than about 200 centipoise, more preferably less than about 100 centipoise, and most preferably less than about 50 centipoise.

Figure 2:
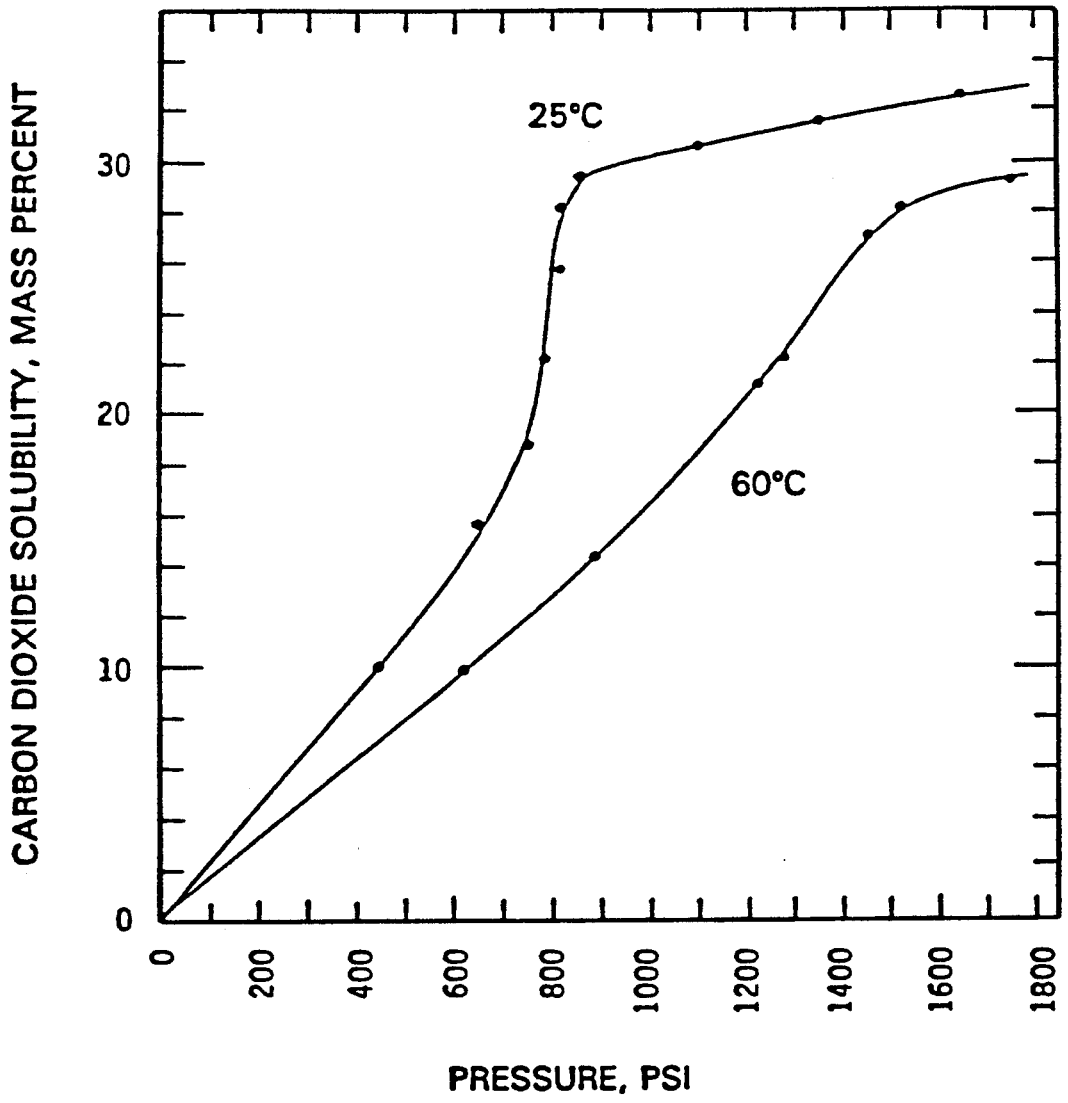
FIG. 2 is a diagram that illustrates how compressed carbon dioxide solubility in a viscous coatings composition increases with pressure.

Increase in compressed carbon dioxide solubility with pressure is illustrated in FIG. 2 at two temperatures that are representative of spraying with subcritical (25° Celsius) and supercritical (60° Celsius) carbon dioxide. The coating concentrate is the same as in FIG. 1. A two phase mixture occurs when the carbon dioxide concentration exceeds the solubility limit. At 60° Celsius, the solubility increases relatively linearly with pressure, but at 25° Celsius, the solubility is higher and, surprisingly, increases markedly between pressures of 700 and 900 pounds per square inch (psi) before increasing more slowly at higher pressure.

In general, for the compressed fluid to produce sufficient viscosity reduction to maintain a transportable composition, the compressed fluid, such as carbon dioxide, should have a solubility in the solvent-borne composition of at least about 10 weight percent, based upon the total weight of compressed fluid and solvent-borne composition, preferably of at least about 15 weight percent, more preferably of at least about 20 weight percent, and most preferably of at least about 25 weight percent.

The undesired solvent may be separated by any method that is compatible with a pressurized mixture that has a large concentration of dissolved compressed fluid, such as extraction, supercritical fluid extraction, gas stripping, supercritical fluid stripping, membrane separation, adsorption, and other separation methods known to those skilled in the art of separation.

The favored separation methods utilize the compressed fluid itself as separation agent or to improve the separation method. For example, when the compressed fluid concentration in the precursor liquid spray mixture is above the solubility limit, the excess non-dissolved compressed fluid forms a compressed fluid phase, which may be used as an extraction or stripping medium. The undesired solvent is then extracted or stripped from the solvent-borne composition into the compressed fluid phase as a mass transfer operation. The compressed fluid phase containing the undesired solvent is then physically separated from the precursor liquid spray mixture, such as by settling, to leave a liquid spray mixture with reduced solvent content but still having low viscosity. The undesired solvent is then recovered from the physically separated compressed fluid phase, such as by depressurization and condensation, for disposal or preferably to be recycled to manufacture more solvent-borne composition. The excess compressed fluid used for the solvent separation is preferably recovered and recycled to the separation procedure.

The method of forming a precursor liquid spray mixture having a compressed fluid phase is not critical. A compressed fluid phase may be formed in one step by adding compressed fluid to the solvent-borne composition in an amount that exceeds the solubility limit at the temperature and pressure of the precursor liquid spray mixture. Alternatively, a compressed fluid phase may be formed in two steps by 1) adding the compressed fluid to the solvent-borne composition at a temperature and pressure at which it is fully dissolved and then 2) changing the temperature and pressure or both to reduce the solubility limit until a compressed fluid phase is formed. For example, compressed fluid solubility can be reduced by reducing pressure or increasing temperature.

The separation can be improved by the compressed fluid maintaining a low viscosity as solvent is separated and also by maintaining a diluted composition so that solvent can readily diffuse through the nonvolatile materials phase to the interface with the separation medium. For example, this can improve membrane separation procedures, where the high solids concentration caused by solvent removal, in the absence of the compressed fluid, would significantly reduce solvent diffusion to the membrane and would tend to block the membrane pores, thereby reducing the rate of solvent passage through the membrane.

The present invention is particularly useful for compositions that are more easily manufactured or blended with solvent, but which could be sprayed without solvent by using compressed fluids as the diluent, such as coating formulations with liquid polymers and solid additive blends with liquid polymer carriers. The solvent can then be substantially or totally separated and the composition can still be sprayed.

The present invention may also be used to alter the solvent blend, in addition to reducing the overall solvent level. Undesired solvents can be preferentially separated while desirable solvents are preferentially retained. For example, a compressed fluid extraction or stripping medium may be used that contains the desired solvent components at their equilibrium levels at the separation conditions used, so that they are not separated by mass transfer. A solvent component can be partially separated by using an extraction or stripping medium with a less than equilibrium level of the solvent component. As another example, solvent components with small molecules may be preferentially separated by membrane separation methods.

The solvent separated from the solvent-borne composition may be recovered from the compressed fluid extraction or stripping medium by procedures known to those skilled in the art of separation, such as by pressure reduction to reduce solubility in the compressed fluid and/or by cooling it to condense solvent vapors, such as in a cold trap. The compressed fluid can then be recompressed, heated, and recycled.

These and other procedures for carrying out the solvent separation prior to spraying will be apparent to those skilled in the art of separation. For example, the solvent separation may be carried out in more than one stage, such as to reduce solvent content to a lower level than is possible with a one stage separation, as is known to those skilled in the art.

Figure 3:
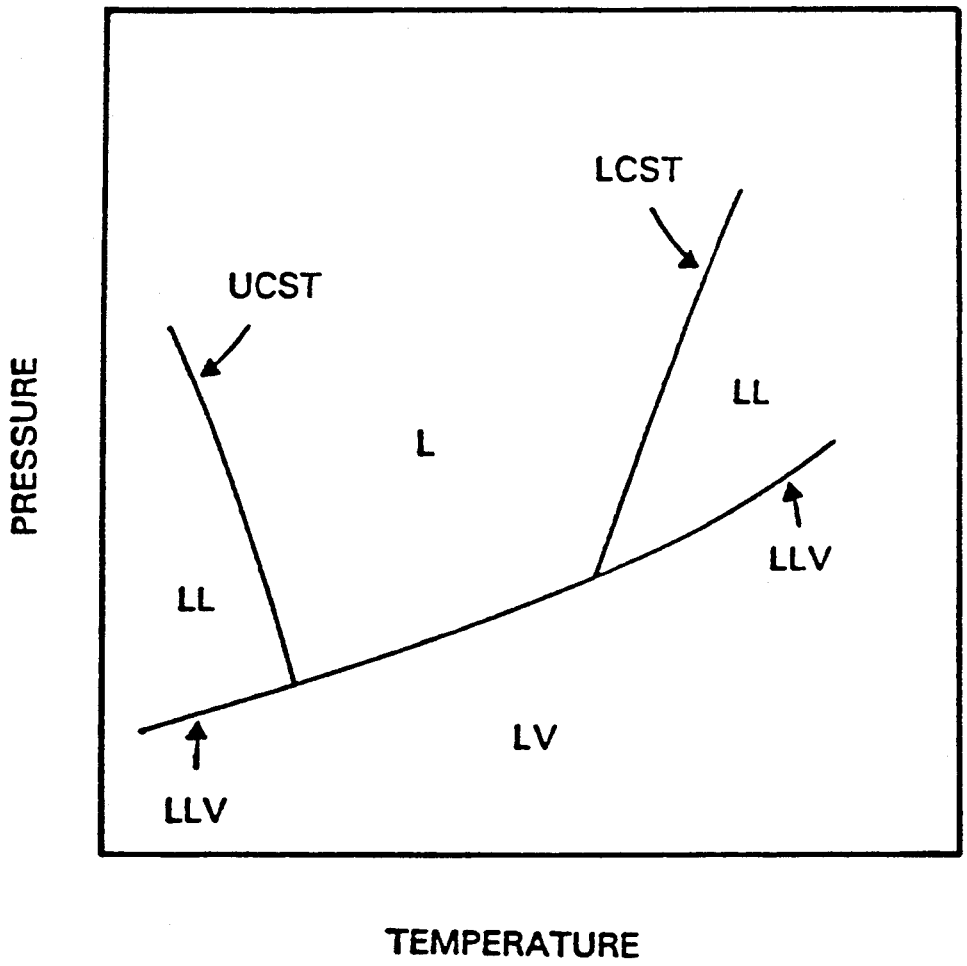
FIG. 3 is a diagram that illustrates the general temperature-pressure phase relationships for a constant overall composition of polymer, solvent, and compressed fluid.

Turning now to how the solvent may be separated by using compressed fluid, FIG. 3 shows a general temperature-pressure phase diagram for a mixture of polymer, solvent, and compressed fluid. The diagram shows the number and type of phases that exist for a fixed overall composition at different combinations of temperature and pressure. A liquid solution of polymer, solvent, and compressed fluid is generally stable over a limited region of temperature and pressure, outside of which two fluid phases are formed. The region marked "L" corresponds to a single liquid phase, wherein the polymer, solvent, and compressed fluid are completely miscible. The regions marked "LL" correspond to two liquid phases, wherein a compressed fluid-rich phase and a polymer-rich phase are in equilibrium, with solvent being distributed between them. The region marked "LV" corresponds to a liquid phase and a vapor phase, wherein a polymer-rich liquid phase and a compressed fluid-rich vapor or gas phase are in equilibrium. The solid lines show the boundaries between these regions. The lines marked "LLV" correspond to very narrow regions in which three phases are in equilibrium: a polymer-rich liquid phase, a compressed fluid-rich liquid phase, and a compressed fluid-rich vapor or gas phase. Because the "LLV" regions are usually small, they are represented by a solid line between the "LL" and "LV" regions.

The phase diagram shows that a vapor or gas phase is present only at sufficiently low pressure and that two liquid phases form only at sufficiently high or low temperature. The line marked "LCST" is called the lower critical solution temperature curve and represents the temperatures above which division into two liquid phases occurs. Similarly, the line marked "UCST" is called the upper critical solution temperature curve and represents the temperatures below which separation into two liquid phases occurs. An increasing fraction of compressed fluid in the overall composition shifts the two-liquid-phases regions bounded by the LCST and UCST curves to lower and higher temperatures, respectively, and shifts the entire diagram to higher pressure. A sufficiently high fraction of compressed fluid can cause the two LL regions to merge at high pressure above the L region.

For purposes of solvent separation coupled with spraying, the two-liquid-phases region of interest is the one that occurs at higher temperature and has an LCST curve. For the discussion that follows hereafter, the phrase two liquid phases refers to this region on the phase diagram. Solvent separations carried out in this region may be considered to be an extraction of solvent from the polymer-rich liquid phase into the compressed fluid-rich liquid phase. The other region of interest is the liquid-vapor region. These separations may be considered to be stripping of solvent from the polymer-rich liquid phase into the compressed fluid-rich vapor, gas, or supercritical fluid phase. After solvent separation, the spray mixture generally is sprayed from within the single-liquid-phase region to fully utilize the remaining solvent for viscosity reduction and to maximize the solvent level in the sprayed polymer, to aid film coalescence and leveling when coatings are applied to a substrate.

Figure 4:
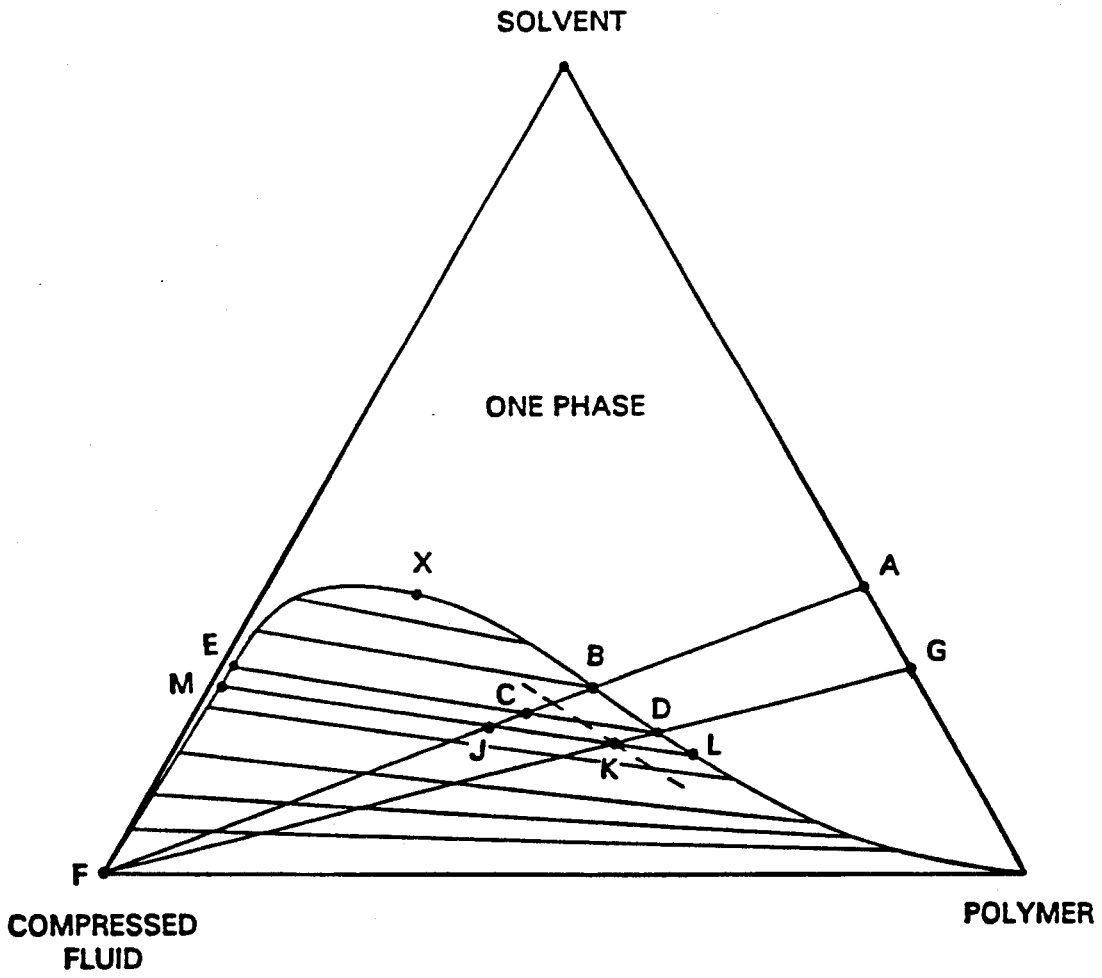
FIG. 4 is a triangular composition phase diagram that illustrates composition points and tie lines used to separate solvent from a given solvent-borne composition by using a compressed fluid.
Figure 5:
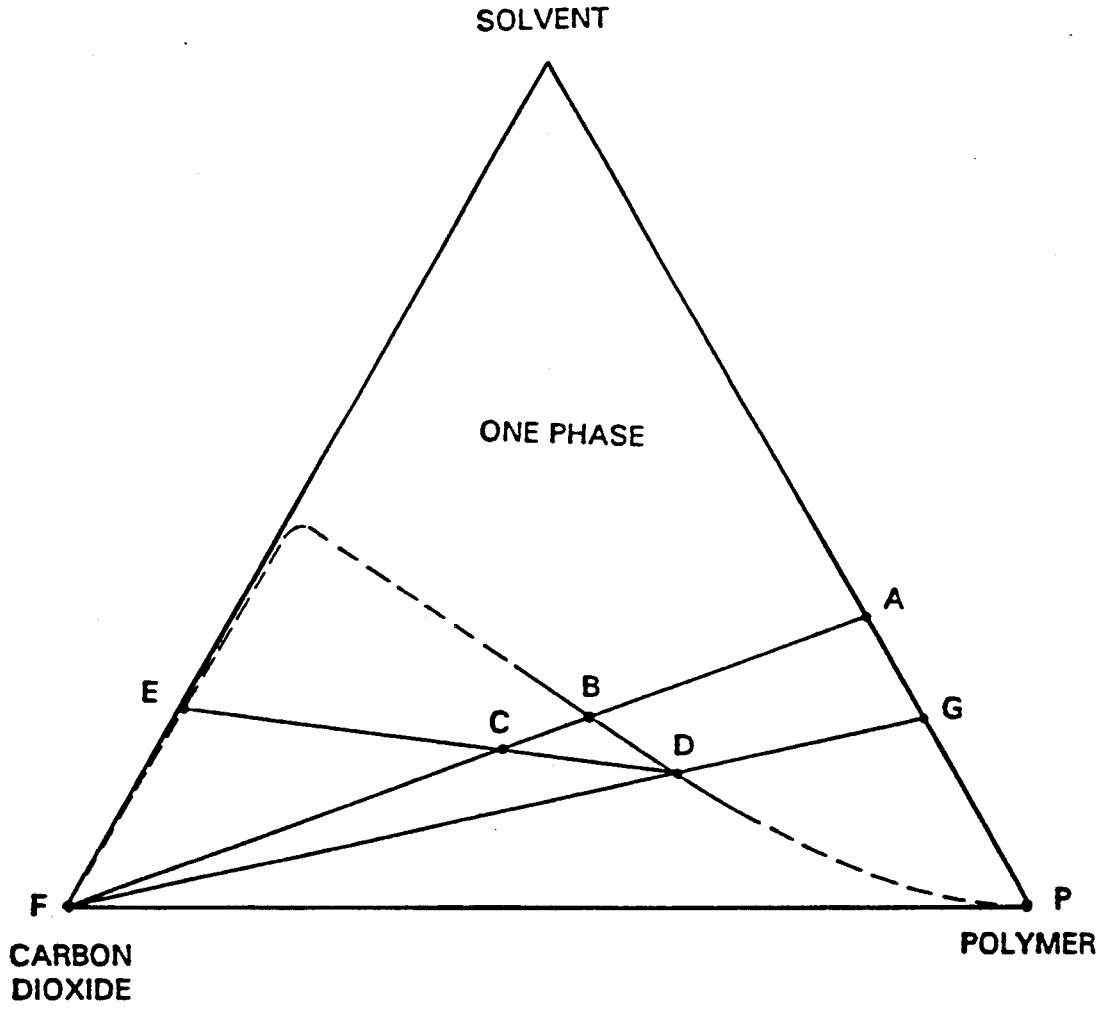
FIG. 5 is a triangular composition phase diagram for an acrylic polymer solvent-borne coating composition showing a measured tie line and composition points used to separate solvent using compressed carbon dioxide at a pressure of 1200 psig and a temperature of 25° Celsius.

Phase relationships for different overall compositions of polymer, solvent, and compressed fluid at constant temperature and pressure are shown using a triangular composition phase diagram, as illustrated in FIG. 4. Pure components correspond to the corners of the triangle. The sides correspond to compositions having just two of the three components. The diagram is based on the geometric principle that the sum of the perpendicular distances from any point to the three sides of an equilateral triangle equals the altitude of the triangle. Therefore, by taking the altitude as 100 percent, the perpendicular distances from any point to the sides corresponds to the individual weight percents of the components. The triangle is divided into a one-liquid-phase region and a two-phase region by the equilibrium curve through Points F-M-E-X-B-D-L-P. The two-phase region, which is bounded by the equilibrium curve and line F-P, can have two liquid phases or it can have a liquid phase and a vapor, gas, or supercritical fluid phase, depending upon the temperature and pressure. Two liquid phases occur at pressures high enough that a gas phase does not form at equilibrium, as shown in FIG. 3. At some combinations of temperature and pressure, the two-phase region can be a three-phase region, but this is unusual. The composition points inside the two-phase region correspond to the overall composition that includes both phases. The compositions of the individual phases lie on the equilibrium curve as connected by tie lines, as illustrated in FIG. 4. Higher pressure increases solubility and therefore reduces the size of the two-phase region.

In general, to obtain sufficient compressed fluid solubility to maintain a transportable viscosity, to obtain a suitably large two-phase region on the phase diagram when such is utilized by the separation procedure, and to obtain good spray performance, preferably the pressures of the precursor liquid spray mixture and the liquid spray mixture each are from about 500 to about 3000 psi, more preferably from about 700 to about 2000 psi. Preferably, the temperatures of the precursor liquid spray mixture and the liquid spray mixture each are from about 25° to about 100° Celsius. The pressure and temperature used for a given application will depend upon the particular properties of the compressed fluid and the solvent-borne composition. The pressure and temperature at which solvent is separated from the precursor liquid spray mixture may be different from the pressure and temperature used to spray the liquid spray mixture.

The solvent used in the solvent-borne composition usually has less effect on compressed fluid solubility than the type of polymer. The phase diagram can be used with mixtures of polymers and mixtures of solvents by lumping the polymers together and the solvents together.

Turning now to how a solvent may be separated from a solvent-borne composition by using compressed fluid to extract the solvent, FIG. 4 illustrates composition points on the phase diagram. Point A is the solvent-borne composition, which contains 65% polymer and 35% solvent and which has a low viscosity and low reactivity. Before spraying the composition with compressed fluid, it is desired to remove 28.5% of the solvent to reduce solvent emissions. This separation corresponds to the concentrate at Point G, which contains 75% polymer and 25% solvent. Concentrate G has a high viscosity, which would make manufacture difficult, and a high solids level, which would make the composition too reactive and reduce pot life. Line A-B-C-J-F shows how the overall composition changes as compressed fluid is added in greater amount to Composition A. Point B is the solubility limit for Composition A, which is the maximum amount of compressed fluid, being 35%, that can be added before two liquid phases form. Similarly, Point D is the solubility limit for Composition G. It corresponds to the desired amount of compressed fluid, being 31%, for spraying composition G with reduced solvent content. Generally, the spray mixture is sprayed at or near the solubility limit to maximize the amount of dissolved compressed fluid and to minimize solvent emission, that is, to maximize solvent removal. The amount of compressed fluid required to separate the desired amount of solvent and to give the desired amount of compressed fluid for spraying corresponds to Point C, which is 44%. This is the point at which tie line D-C-E intersects line A-B-C-J-F for solvent-borne Composition A. Therefore, to accomplish the desired separation at the fixed temperature and pressure of the phase diagram, which corresponds to the desired spray temperature and pressure, compressed fluid is added to solvent-borne Composition A to form a two-phase mixture containing 44% compressed fluid overall (Point C). The two liquid phases in equilibrium correspond to Points D and E, as connected by the tie line. Point D is the desired composition of the polymer-rich liquid phase that comprises the desired spray mixture. Point E is the composition of the compressed fluid-rich liquid phase that contains the desired amount of separated solvent and the excess compressed fluid not desired for spraying, but which contains very little polymer. The two phases are allowed to physically separate by settling and then the compressed fluid-rich phase (Point E) is removed from the mixture to leave the desired spray mixture (Point D) having reduced solvent content and the proper amount of dissolved compressed fluid. The solvent separated is recovered from the compressed fluid phase (Point E) by condensation as the compressed fluid is depressurized to atmospheric pressure.

During the process of physically separating the two liquid phases, it is sometimes inconvenient to separate the phases completely by drawing off all of the compressed fluid-rich phase. The last residual portion of the compressed fluid-rich phase may require a long time to separate by migration through the polymer-rich phase, due to the higher viscosity of the polymer-rich phase. However, the polymer-rich phase usually settles quickly from the compressed-gas phase, due to the low viscosity of that phase. Also, complete separation may not be possible because portions of the compressed fluid-rich phase may become trapped in portions of the equipment. Therefore, it may be convenient to do the separation at a pressure somewhat below the desired spray pressure and to allow for an incomplete separation of the phases. This procedure is also illustrated in FIG. 4. The equilibrium curve F-M-E-X-B-D-L-P, drawn as a solid line, corresponds to the separation pressure, which is lower than the desired spray pressure. A portion of the equilibrium curve at the higher spray pressure is indicated by the dashed line through Point K, which corresponds to the desired spray mixture after the desired amount of solvent has been separated. To achieve the same removal of solvent as before, a larger amount of compressed fluid is added to solvent-borne Composition A to give the overall composition at Point J, which has 49% compressed fluid. The equilibrium compositions of the two phases are now given by Points L and M on the tie line through Point J. After the two phases have physically separated by settling, only a portion of the compressed fluid-rich phase is withdrawn to give the spray solution composition at Point K, which has 36% compressed fluid. The pressure is then increased to shift the equilibrium curve to pass through Point K so that a single-phase solution is sprayed.

The diagram used for illustration in the preceding examples show the tie lines sloping downward when going from left to right on the composition phase diagram. Using compressed fluid to separate the solvent does not require that the tie lines have a particular slope; the slope merely affects the amount of compressed fluid that must be used for the separation. For example, if the tie lines sloping upward instead of downward, more compressed fluid is necessary to separate the same amount of solvent.

The removal of excess solvent may also be done by carrying out the separation at a lower pressure at which the compressed fluid-rich phase is a dense gaseous or supercritical fluid phase. This may be desirable, because the gas phase physically separates from the polymer-rich phase more quickly than a liquid phase does. Gaseous or supercritical fluid phase separation may also be useful to fractionate the solvents separated, because solvents with high volatility and high vapor pressure may be preferentially stripped or extracted into the gas phase much more than solvents with low volatility and low vapor pressure. The solvent separation must be done at sufficiently high temperature to increase the volatility of the fast evaporating solvents. In spraying compositions with compressed fluids, it is desirable to remove the fast evaporating solvents, which are replaced by the compressed fluid, and to retain just the slow evaporating solvents, to aid film coalescence and leveling, such as when applying coatings to a substrate. Conducting the separation under stripping conditions generally requires using much more compressed fluid than under extraction conditions, because the solvent has lower solubility in the compressed fluid-rich phase.

In general, in the practice of the present invention, the precursor liquid spray mixture should contain at least about 15 weight percent compressed fluid, based upon the total weight of compressed fluid and solvent-borne composition, preferably at least about 20 weight percent, and more preferably at least about 25 weight percent compressed fluid. In general, the amount of compressed fluid used for a given application depends upon the separation procedure utilized, the temperature and pressure at which the separation is done, the compressed fluid solubility in the solvent-borne composition, the solvent solubility in the compressed fluid, and the amount of solvent desired to be removed.

The amount of solvent desired to be separated from the precursor liquid spray mixture generally will depend upon the solvent level in the solvent-borne composition and the minimum solvent level required for the spray application. To obtain the same low solvent level in the spray mixture, in order to reduce solvent emissions to a low level, while retaining an adequate solvent level for the application, such as for film formation, it is necessary to remove a greater amount of solvent from dilute solvent-borne compositions with high solvent level than from compositions that are already relatively concentrated. In general, to significantly reduce solvent emission from the spray, preferably at least about 20 percent by weight of the solvent fraction is separated from the precursor liquid spray mixture, more preferably at least 30 percent. In applications that require little or no solvent for spraying or for the application, such as the application of liquid polymer coatings or the application of additives to polymeric substrates, most preferably the solvent is substantially separated from the liquid precursor mixture.

Figure 8:
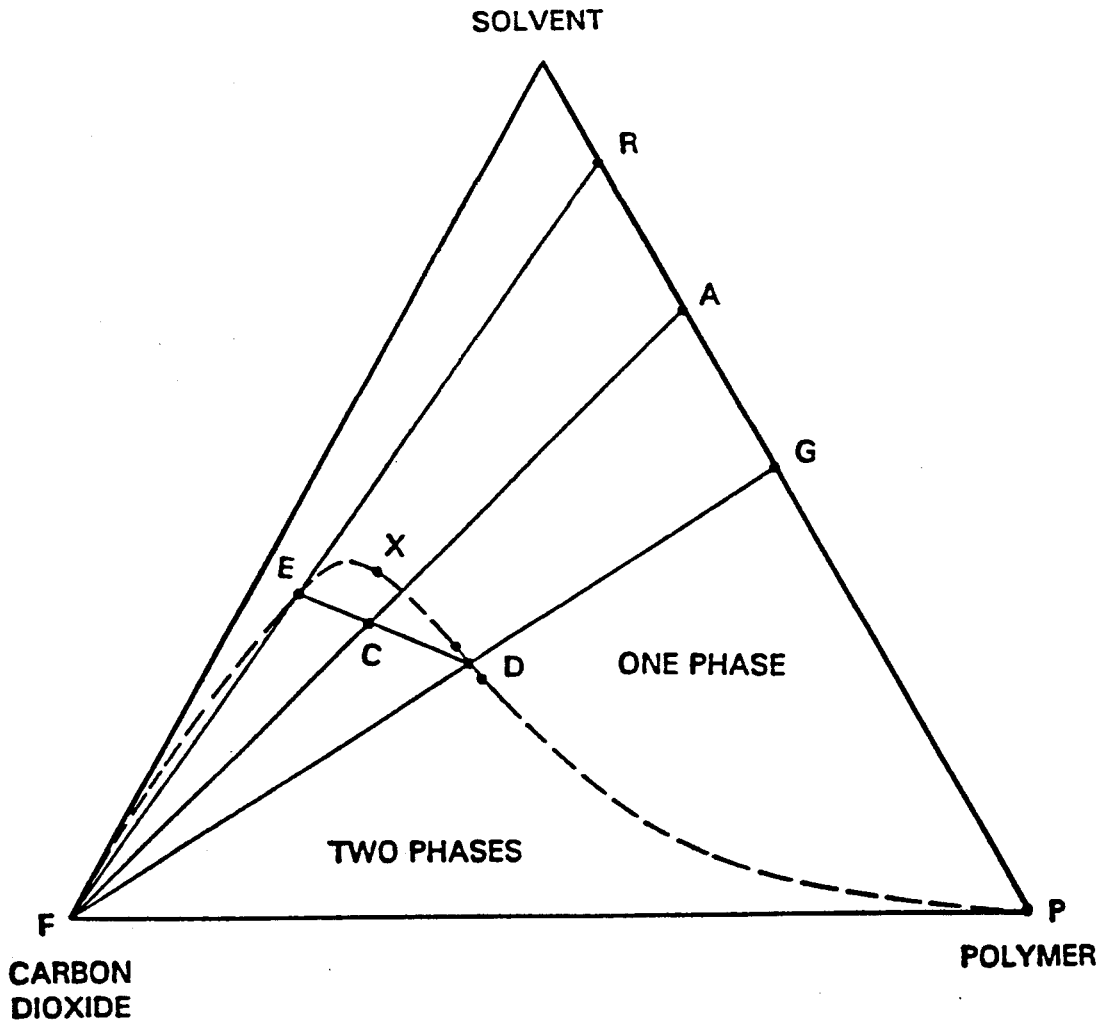
FIG. 8 is a triangular composition phase diagram for a thermoplastic acrylic polymer, methyl amyl ketone solvent, and compressed carbon dioxide that shows a measured tie line near the compositional critical point and composition points that could be used to separate solvent.

FIG. 8 shows a measured composition phase diagram for a solvent-borne coating composition (Point A) that consists of 30% Acryloid TM B-66 acrylic polymer and 70% methyl amyl ketone solvent, by weight. The compressed fluid is carbon dioxide at a supercritical temperature of 50° Celsius and a high supercritical pressure of 1800 psi. The measured tie line E-C-D, which is close to the compositional critical point X, connects two liquid phases that are formed by adding carbon dioxide to form a precursor liquid spray mixture (Point C) having 51.2% carbon dioxide. The compositional critical point X is the composition at the given temperature and pressure wherein the compositions of the two liquid phases in equilibrium become identical. The composition of the polymer-rich phase (Point D) is 27.0% polymer, 43.3% carbon dioxide, and 29.7% solvent, which forms the liquid spray mixture. The composition of the carbon dioxide-rich liquid phase (Point E) is 57.0% carbon dioxide, 38.0% solvent, and 5.0% polymer. The liquid spray mixture when free of carbon dioxide (Point G) would have 61.0% less solvent than the solvent-borne composition (Point A). However, the removed carbon dioxide-rich phase, when free of carbon dioxide (Point R), would contain 11.6% polymer. Therefore, about 25% of the polymer is removed with the solvent. This illustrates that it is preferable to conduct the solvent separation sufficiently removed from the compositional critical point such that the polymer has low solubility in the carbon dioxide-rich phase. Of course, the polymer in the carbon dioxide rich phase can be recovered along with the solvent and recycled to the manufacturer of the solvent-borne composition.

Figure 9:
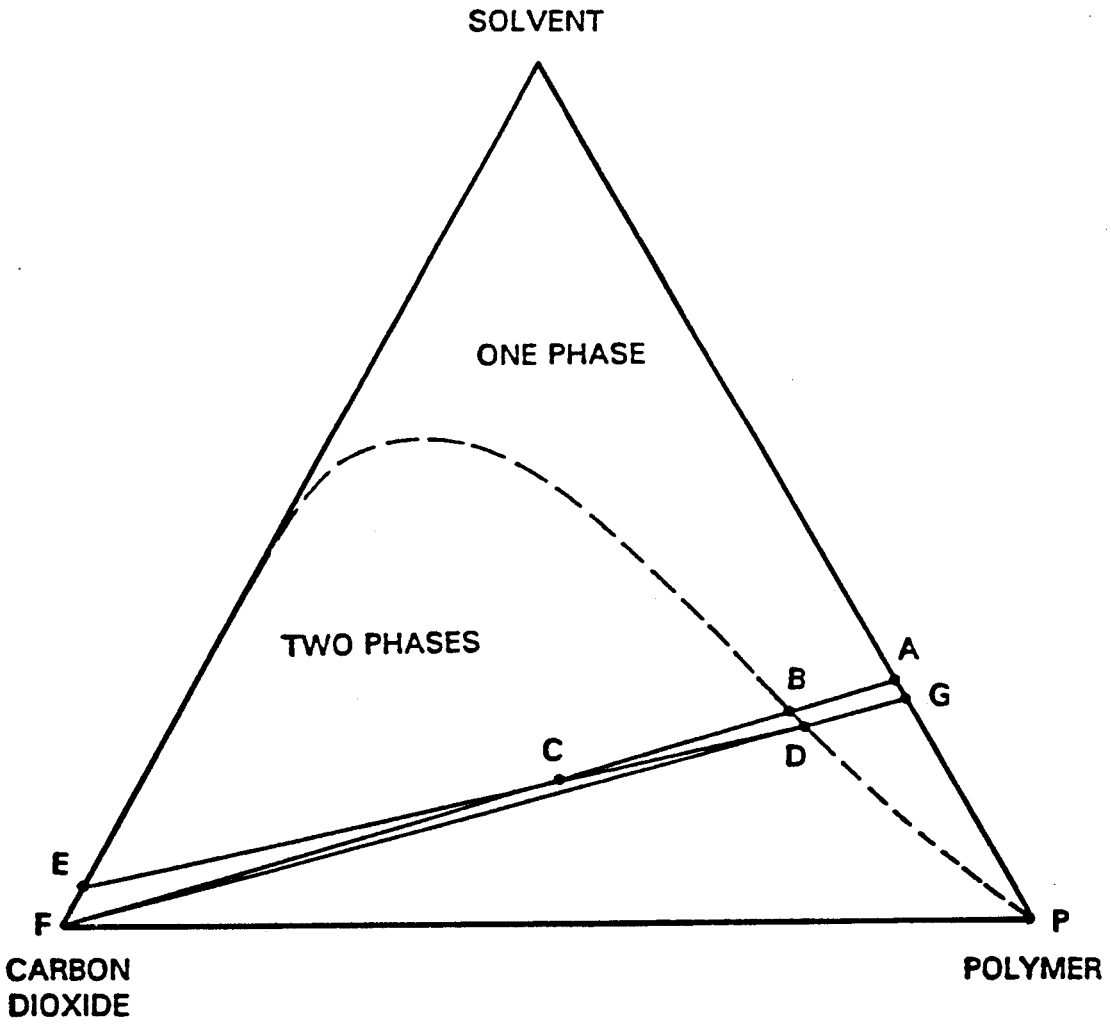
FIG. 9 is a triangular composition phase diagram that illustrates a tie line and composition points for a two-phase system with a liquid polymer-rich phase and a dense gaseous or supercritical carbon dioxide-rich phase.

FIG. 9 illustrates solvent removal under conditions in which dense gaseous carbon dioxide, such as supercritical carbon dioxide, is used as a stripping medium, which corresponds to the "LV" region in FIG. 3. Tie line E-C-D connects a liquid polymer-rich phase (Point D) and the carbon dioxide-rich phase (Point E). Because the carbon dioxide has a lower density than is required for it to function as an extraction medium, much less solvent is dissolved into the carbon dioxide-rich phase than if it were an extractant as in FIGS. 4 to 8. Therefore, a much great amount of carbon dioxide is required to achieve significant solvent removal and a multi-stage separation must generally be used, such as by using counter-current flow through a packed stripping column, as is known to those skilled in the art. In FIG. 9, the two phases were formed by adding carbon dioxide to the solvent borne composition (Point A) to form a precursor liquid spray mixture (Point C) having 40.0% carbon dioxide by weight. The polymer-rich phase (Point D) contains 63.1% polymer,, 23.6% solvent, and 13.3% carbon dioxide. The carbon dioxide-rich phase (Point E) contains 95.9% carbon dioxide and 4.1% solvent. The polymer-rich phase, when free of carbon dioxide (Point G), has been stripped of 7.7% of the solvent content in the initial solvent-borne composition (Point A). To be sprayed, additional carbon dioxide must generally be added to the polymer-rich phase and the pressure increased to give a single-phase spray mixture. This illustrates that solvent stripping with dense gaseous carbon dioxide is much less favorable for solvent removal than solvent extraction with a higher density liquid carbon dioxide-rich phase, which is the preferred embodiment.

The liquid spray mixture is sprayed by passing it under pressure through an orifice to form a spray. Orifice sizes of from about 0.007-inch to about 0.025-inch nominal diameter are preferred. Spray droplets are produced which have an average diameter of one micron or greater, preferably from about 10 to about 200 microns. The liquid spray mixture is preferably sprayed at a temperature and pressure at which the compressed fluid is a supercritical fluid. The spray is preferably a decompressive spray that is feathered, has a parabolic shape, and is wider than conventional airless sprays.

If a coating is deposited by the spray, the form of the coating and the composition of the substrate are not critical to the present invention. The form of additives deposited on a polymeric substrate for polymer processing is not critical, and may be a coherent film, a pattern of droplets, a pattern of particulates, a mixture of additive and polymer particulates, or a combination thereof. The method of deposition and form of the polymeric substrate are also not critical. The additives may be sprayed onto a moving bed of particulate or pellet polymer; be sprayed into a fluidized, agitated, or mixed bed of powder or pellet polymer; be sprayed into a spray of powder or pellet polymer; and the like. Preferably the additives are deposited in a uniform manner and in the proper amount or ratio to effect proper processing of the polymer substrate, such as extrusion to form a plastic product.

Figure 10:
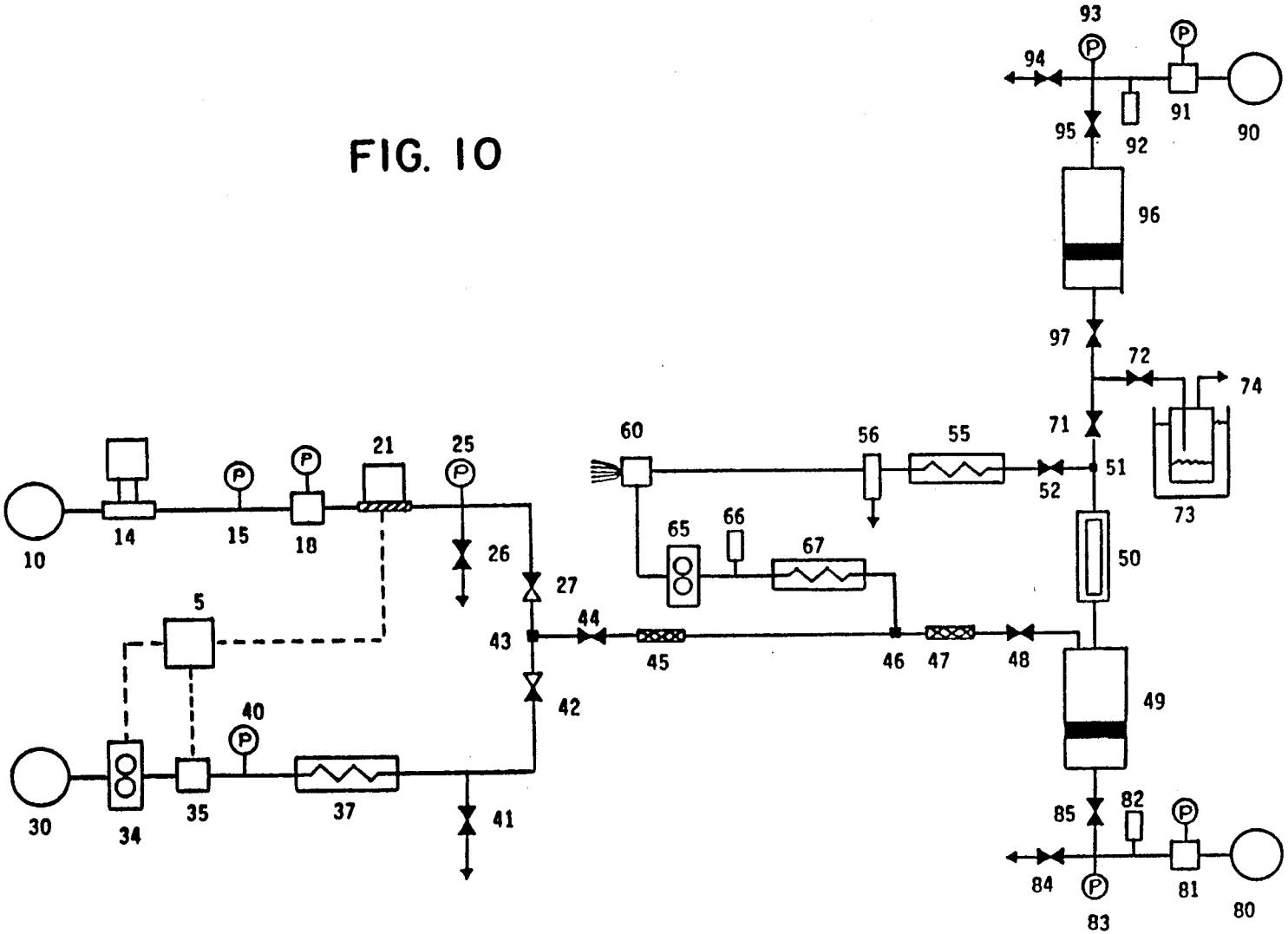
FIG. 10 is a schematic diagram of a batch method and apparatus for admixing compressed fluid with a solvent-borne composition, separating solvent by using compressed fluid, and spraying the resulting liquid spray mixture.

Turning now to a method that may be used in the practice of the present invention, FIG. 10 shows an apparatus that operates in a batch mode. Carbon dioxide from a cylinder 10 is pressurized by pump 14, such as Haskel model 8DSFD-25, to a pressure between 1600 and 2000 psig (pressure gauge 15) and then regulated to the desired process pressure (pressure gauge 25) by pressure regulator 18. Mass flow meter 21, such as Micro Motion model D6, measures the mass of carbon dioxide fed through check valve 27 to mix point 43 for blending with solvent-borne composition. Valve 26 is a drain valve.

The solvent-borne composition is supplied from tank 30 and pressurized to 200 to 1200 psi by a supply pump (not shown). It is pressurized (pressure gauge 40) and metered by precision gear pump 34, such as Zenith model HLB-5592. Precision gear meter 35, such as AW Company model ZHM-02, measures the delivered amount. The solvent-borne composition then flows through optional heater 37 and check valve 42 to mix point 43. Valve 41 is a drain valve.

The speed command of gear pump 34 may be electronically controlled by an input signal from mass flow meter 21 by using control system 5, such as Zenith ZeDrive Speed Control System model 17, to automatically obtain the desired proportion of solvent-borne composition and carbon dioxide when the system is filled. A multi-channel flow computer, such as AW Company model EMO-1005, is used for cumulative amount and flow rate computation. The metering rate is electronically adjusted by a feedback signal from gear meter 35 to correct for pumping inefficiency. Metering pump 34 may also be manually controlled to batch meter the materials, but concurrent addition is preferred to premix the materials.

The blended feed is mixed in static mixer 45 and added to a circulation loop at mix point 46. The material flows through static mixer 47, valve 48, accumulator 49, such as Tobul model 4.7A30-4, sight glass 50, heater 55, valve 52, filter 56, spray gun 60, circulation pump 65, such as Zenith gear pump model HLB-5592, pressure relief valve 66, and optional heater 67, back to mix point 46. The lines, accumulators, and equipment in the heated loop are insulated to prevent heat loss.

Accumulator 49 comprises a piston in a cylinder and is used for separating solvent and for maintaining constant spray pressure. The circulating material preferably flows through the accumulator. The volume and pressure in the accumulator (pressure gauge 83) are controlled by pressurized nitrogen obtained from nitrogen cylinder 80 through pressure regulator 81, pressure relief valve 82, and valve 85. Nitrogen is vented through valve 84 to lower the pressure.

The separated solvent and excess carbon dioxide are withdrawn from accumulator 49 and the circulation loop through separation point 51 and valve 71. The solvent and carbon dioxide mixture are depressurized through slow-opening valve 72 to cold trap 73, such as a condenser vessel immersed in a cold bath, where the solvent is condensed and recovered from the gaseous carbon dioxide, which is released to the atmosphere through vent 74. Optional accumulator 96 may be used to draw off the mixture of separated solvent and carbon dioxide at constant pressure through isolation valve 97 before it is depressurized to recover the separated solvent. It is pressurized with nitrogen in the same manner as accumulator 49, using nitrogen cylinder 90, pressure regulator 91, pressure relief valve 92, pressure gauge 93, vent valve 94, and isolation valve 95.

To operate the batch unit, the feed system is primed with carbon dioxide and regulator 18 is set to the desired pressure. The circulation loop and accumulators 49 and 96 are purged of air by using gaseous carbon dioxide. The feed system is primed with solvent-borne composition and controller 5 is set to give the desired mass proportion of carbon dioxide to solvent-borne composition. The loop is then filled, with accumulator 49 being at low nitrogen pressure to nearly fill it. After filling, valve 44 is closed, circulation pump 65 is turned on, and the heaters are adjusted to the desired separation temperature. The nitrogen pressures in accumulators 49 and 96 are then adjusted to match the loop pressure established by regulator 18 during filling.

After the contents of the loop are mixed and heated to the desired separation temperature, pump 65 is turned off and the two phases are allowed to physically separate into two layers in accumulator 49. The carbon dioxide-rich phase containing dissolved solvent rises to the top and is then withdrawn from accumulator 49 through sight glass 50 and valve 71 to either accumulator 96 or through valve 72. Valve 71 is then closed and the procedure repeated one or two times after briefly circulating the material through accumulator 49. If accumulator 96 is used, after the carbon dioxide-rich phase has been withdrawn, valve 71 is closed and the carbon dioxide phase is depressurized into condenser 73, where the solvent is condensed and collected. If desired, more carbon dioxide may be added to the circulation loop to separate more solvent.

After solvent has been separated from the precursor liquid spray mixture, the liquid spray mixture thus formed is sprayed from spray gun 60, such as a Nordson model A7A airless spray gun, by turning on pump 65 and using nitrogen pressure regulator 81 to adjust the loop pressure to the desired spray pressure, if different from the separation pressure. As the spray mixture is sprayed, accumulator 49 maintains constant spray pressure and circulation through heaters 55 and 67 maintains constant spray temperature.

Figure 11:
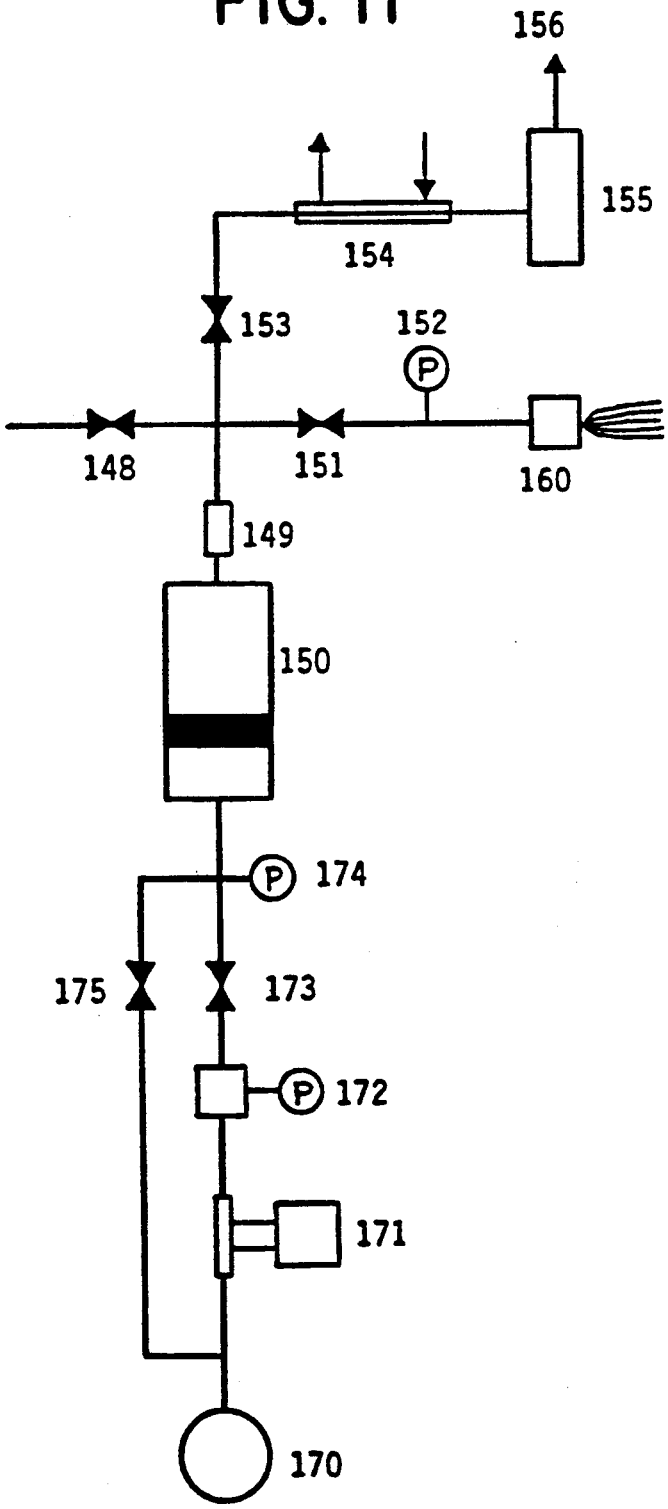
FIG. 11 is a schematic diagram of a preferred batch method and apparatus.

A preferred batch method is illustrated in FIG. 11. Thermostatted heat tracing (not shown) of accumulator 150, spray gun 160, and the piping and hose that connect them is used to maintain the desired separation and spray temperature instead of circulation through a heater. Therefore, the carbon dioxide-rich phase can be removed in one step. The heat tracing may be electrical or preferably uses a circulating heat transfer medium, such propylene glycol in water. The heat traced equipment and lines are insulated. The carbon dioxide and solvent-borne composition are fed through valve 148 from the same feed system (not shown) illustrated in FIG. 10.

The pressure in accumulator 150 is regulated by using a pressure transfer fluid such as hydraulic fluid or preferably a solution of polymer in solvent. The pressure transfer fluid supply 170 may be a cylinder, a tank, or a pressure pot. The pressure transfer fluid is pressurized by air driven pump 171, such as Haskel pump model 8DSFD-25, to a pressure above the desired operation pressure, such as between about 1200 and 2000 psig. Pressure regulator 172 regulates the pressure supplied to accumulator 150 (pressure gauge 174) through valve 173. Pressure transfer fluid is removed from the accumulator, depressurized, and delivered back to supply 170 through slow opening valve 175. Nitrogen may be used as the pressure transfer fluid and vented to the atmosphere instead of to supply 170, which would be a nitrogen cylinder. The physically separated carbon dioxide-rich phase containing dissolved solvent is withdrawn from accumulator 150 through sight glass 149 and slow opening valve 153, where it is depressurized to atmospheric pressure. It then passes through optional solvent condenser 154, which is cooled by circulating a refrigerated heat transfer medium, such as propylene glycol in water. The condensed solvent is recovered in receiver 155 and the carbon dioxide is vented to the atmosphere through vent 156, which may contain a mist eliminator. The spray mixture is sprayed by passing the mixture from accumulator 150 through valve 151, by pressure gauge 152, to spray gun 160.

To operate the apparatus, the carbon dioxide and solvent-borne composition premixed feeds are metered through valve 148 in a similar manner to that previously described, with the heat tracing set to the desired temperature. After accumulator 150 is filled, valve 148 is closed and pressure regulator 172 is set to match the pressure in the accumulator. The carbon dioxide-rich phase with dissolved solvent is then allowed to physically separate from the solvent-borne composition phase. The carbon dioxide layer is then entirely withdrawn through slow opening valve 153, as seen in sight glass 149, and depressurized into condenser 154 and receiver 155, where the solvent is condensed and collected. As the carbon dioxide layer is withdrawn, constant pressure is maintained by pressure regulator 172. After the undesired solvent and excess carbon dioxide have been separated from the precursor liquid spray mixture, the liquid spray mixture thus formed is sprayed from spray gun 160 at constant pressure. The spray pressure may be adjusted by using regulator 172.

Membrane separation methods, such as ultrafiltration and pervaporation, may also be used in the present invention. A membrane is a microporous structure that acts as a filter in the range of molecular dimensions, allowing passage of very small molecules, such as solvents and compressed fluids, but being mostly impermeable to larger molecules and macromolecules, such as polymeric compounds, and to colloidal particles and particulates. The permeation rate of solvent and compressible fluid through the microporous membrane depends on the membrane area, the porosity, the pore size, the membrane thickness, and the pressure drop across the membrane, as is known to those skilled in the art. A sufficiently large total membrane area is used to give the desired total permeation rate for the desired pressure drop across the membrane, which must not exceed the recommended mechanical design limits of the membrane and its support structure. In general, the pressure drop across the membrane is preferably below about 800 psi, more preferably below about 400 psig.

To flow or diffuse readily through the membrane, the solvent should have low molecular weight so that the molecules have sufficiently small size and high diffusivity. Therefore, preferably the solvents have a molecular weight less than about 200, more preferably less than about 150, and most preferably, less than about 100.

To efficiently separate solvent and minimize membrane fouling, that is, to prevent the polymeric compounds from entering significantly into the pores, the polymeric compounds should have high molecular weight. Preferably, the polymeric compounds have an average molecular weight above about 5000, more preferably, above about 10,000, and most preferably, above about 20,000.

The membrane pores must be large enough for solvent to readily diffuse through the membrane but small enough to reject the polymeric compounds. The membrane preferably has an average pore size of about 40 Angstroms to about 300 Angstroms, more preferably about 40 Angstroms to about 200 Angstroms, and most preferably about 50 Angstroms to about 100 Angstroms.

The membrane must be constructed of material that is compatible with the solvents and compressible fluid. Preferred membrane materials are sintered metal and ceramic materials made from relatively uniform particles that give a uniform pore size. The most preferred membrane materials are sintered gamma alumina and zirconia, such as in Membralox/ceramic membrane ultrafilters. The membrane and support structure preferably have a graduation of pore sizes, either continuously or in layers. Such graduated designs give good selectivity, inherent resistance to fouling, and high permeation rates.

The geometrical design of the membrane and support structure is not narrowly critical to the present invention provided that it has sufficient mechanical integrity for the pressure drop across the membrane. Preferably, the membrane is a thin layer that lines the interior of a tubular channel in a porous support. To increase membrane area, several membrane tubes may be used in parallel or a monolithic porous support may have multiple flow channels lined with a membrane layer, as is known to those skilled in the art of ultrafiltration. The one or more support pieces are enclosed in a housing or module that allows the precursor liquid spray mixture to flow through the one or more membrane channels under pressure. Solvent and compressed fluid diffuse through the membrane and porous support, and exit the housing or module at lower pressure as a separate flow. If desired, more than one such unit may be used in parallel or in series.

Figure 12:
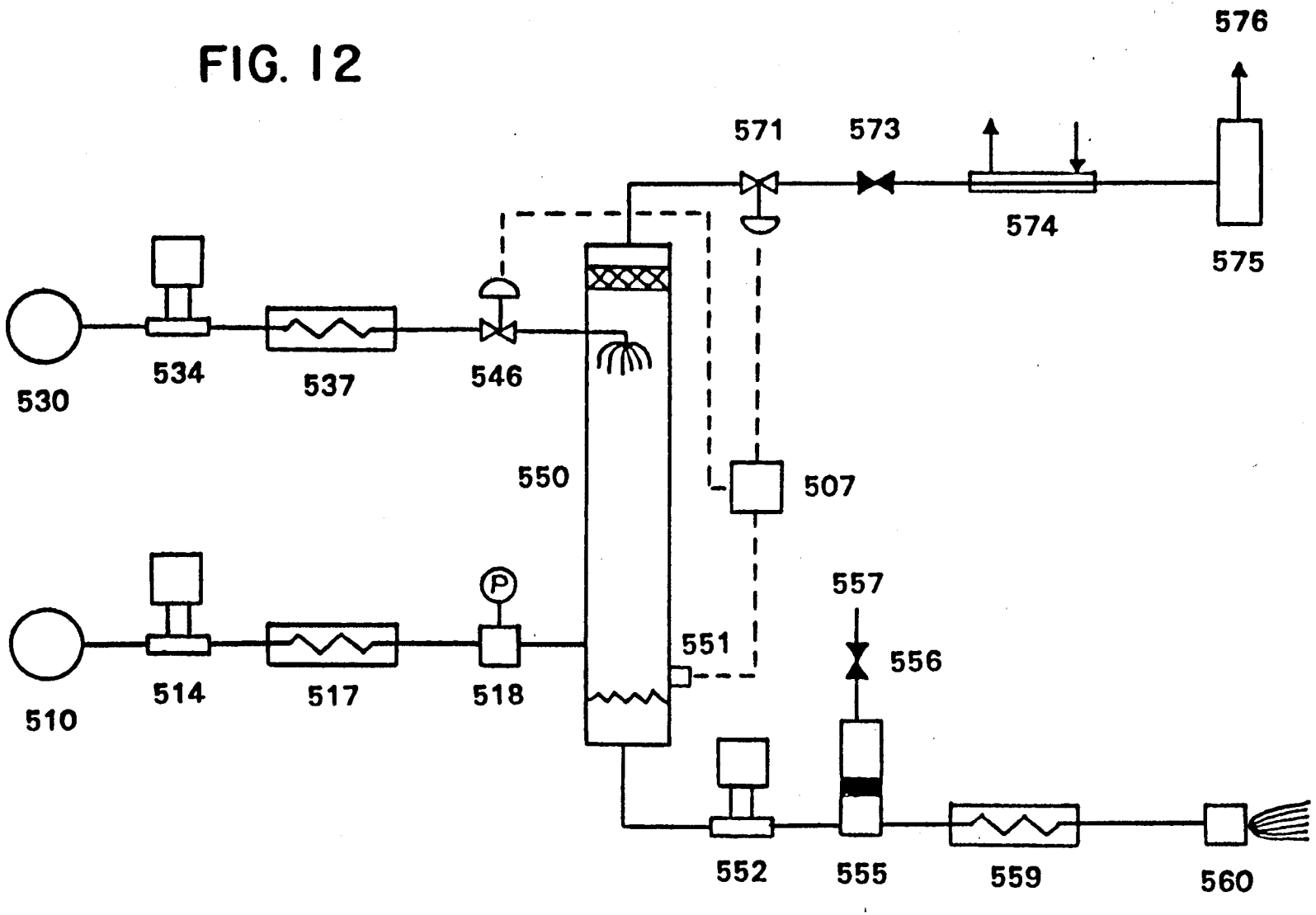
FIG. 12 is a schematic diagram of a continuous method and apparatus for admixing compressed fluid with a solvent-borne composition, separating solvent by using a membrane, and spraying the resulting liquid spray mixture.

A continuous method and apparatus that use a membrane to separate solvent from the precursor liquid spray mixture is illustrated in FIG. 12. The carbon dioxide and solvent-borne composition feed systems are the same as those described for the batch method; elements 410, 414, 418, 421, 425, 426, 427, 428, 430, 434, 435, 437, 440, 441, 442, and 445 in FIG. 12 are analogous to elements 10, 14, 15, 18, 21, 25, 26, 27, 43, 30, 34, 35, 37, 40, 41, 42, and 45 in FIG. 10. The precursor liquid spray mixture formed at mix point 428 passes through membrane unit 446, such as a Membralox/ceramic membrane ultrafilter module having a 100 Angstrom pore size, wherein a portion of the solvent and carbon dioxide passes through the membrane and is separated from the precursor liquid spray mixture. The separated solvent and carbon dioxide pass through mass flow meter 470, where the flow rate is measured, and control valve 471. The pressure drop across the membrane is controlled by pressure regulator 472, which also controls the rate and amount of solvent passed through the membrane. Control valve 471 is closed by controller 405 whenever carbon dioxide is not flowing through feed mass flow meter 421. This causes the pressure drop across the membrane to drop to zero, when material is not flowing through the membrane unit, so that an excessive amount of solvent is not separated from the static mixture. When control valve 471 is opened, the pressure drop across the membrane is re-established and solvent separation resumes. The separated solvent and carbon dioxide are depressurized to atmospheric pressure by passing through regulator 472 and valve 473. The solvent is condensed in condenser 474 and collected in receiver 475. The separated carbon dioxide is vented to the atmosphere through vent 476 or it may be recompressed and recycled.

The liquid spray mixture thus formed in membrane unit 446 is depressurized if desired to the desired spray pressure by pressure regulator 447 and flows into a circulation loop at mix point 448. The circulation loop contains heater 455, which gives the desired spray temperature, pressure gauge 457, spray gun 460, circulation pump 465, and accumulator 466, which is filled with compressed nitrogen from nitrogen cylinder 468 through isolation valve 467.

To operate the apparatus, controller 405 is set to the desired feed mass ratio of carbon dioxide to solvent-borne composition. Regulator 418 and heater 437 are set to the desired pressure and temperature for the membrane separation. The membrane unit and circulation loop are then filled with material. The solvent and carbon dioxide pass through the membrane and pressure regulator 472 is set to give the desired pressure drop across the membrane. When the circulation loop is filled, pump 465 is turned on, regulator 447 is set to the desired spray pressure, and heater 455 is set to the desired spray temperature.

Activation of spray gun 460 causes material to leave the circulation loop and the pressure to drop, which causes flow through regulator 447 into the loop, which in turn causes carbon dioxide to flow through regulator 418. Measurement of the carbon dioxide flow by mass flow meter 421 activates pump 434, which provides solvent-borne composition at the proper flow rate to obtain the desired mass ratio of feed materials. Mass flow through mass flow meter 421 opens control valve 471 and allows solvent and carbon dioxide to flow across the membrane. The separated solvent is condensed in condenser 474 and collected in receiver 475.

Figure 13:
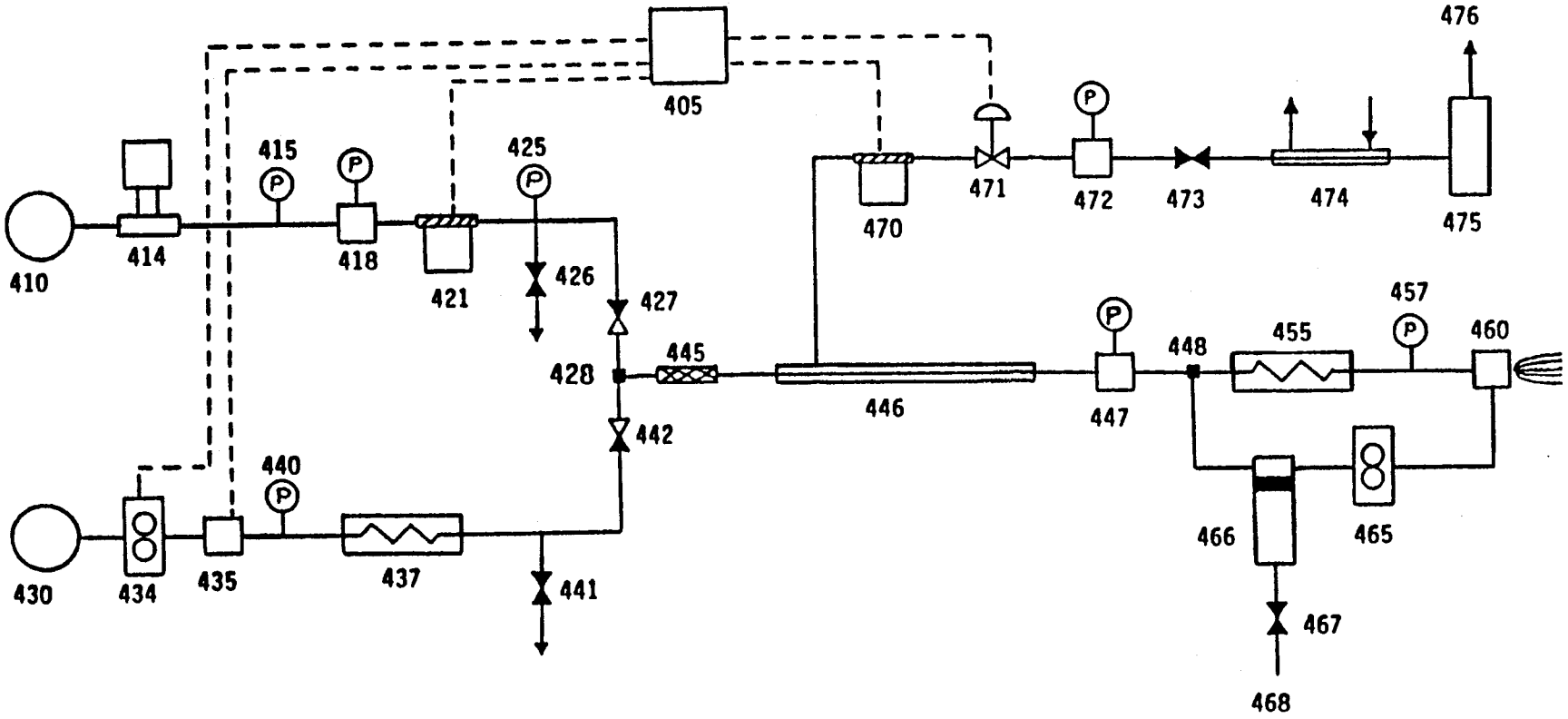
FIG. 13 is a schematic diagram of a continuous method and apparatus for admixing compressed fluid with a solvent-borne composition as solvent is separated by using compressed fluid, and for spraying the resulting spray mixture.

Another continuous method and apparatus is illustrated in FIG. 13. The same vessel is used to dissolve carbon dioxide into the solvent-borne composition to the solubility limit and to separate solvent by liquid extraction or supercritical fluid extraction into the carbon dioxide. The spray line and spray gun are thermostatted to use single-pass flow with no circulation, but a circulation loop may be used if desired. Carbon dioxide is supplied from a carbon dioxide supply system 510 as previously described. The carbon dioxide is pressurized by pump 514, heated by heater 517 to the desired separation temperature, and supplied to column 550 through pressure regulator 518, which controls the desired separation pressure in the column. The solvent-borne composition is supplied from supply 530 as previously described. It is then pressurized by air-driven pump 534 to the desired pressure for spraying it into column 550. It is heated if desired by heater 537 to the desired separation temperature. Heating lowers viscosity and increases solvent volatility. Control valve 546 turns the flow of solvent-borne composition on and off in response to controller 507 and liquid level indicator 551, which detects the liquid level electronically, such as by electrical conductance or capacitance, to maintain a constant liquid level in column 550. The solvent-borne composition is preferably sprayed into the top of column 550 through one or more airless spray nozzles at a total rate higher than the total spray rate through the one or more spray guns 560. The solvent-borne composition is sprayed at a pressure high enough above the pressure in column 550 to atomize and disperse the material. The atomized solvent-borne composition falls, settles, or flows through the continuous carbon dioxide phase and collects at the bottom of the column. The vessel may contain suitable packing (not shown) to better distribute the two phases and to increase mass transfer between them. Carbon dioxide is dissolved into the atomized solvent-borne composition and solvent is separated from it into the carbon dioxide phase. The column is operated at a temperature and pressure that will give the desired separation and that will also give the desired concentration of dissolved carbon dioxide in the solvent-borne composition phase for spraying. The carbon dioxide-rich phase with separated solvent exits the top of the column through control valve 571, which turns the flow rate on and off in response to a signal from controller 507. An entrainment separator or demister may be used at the top of the column to remove entrained droplets from the carbon dioxide phase withdrawn. Controller 507 opens valve 571 whenever it opens valve 546 to spray solvent-borne composition into the column to maintain the liquid level. Controller 507 closes valve 571 when it closes valve 546. Pressure let-down valve 573 is adjusted to give the proper carbon dioxide flow rate to separate solvent from the column at the desired rate. If desired, the mass flow rate of carbon dioxide and solvent through valve 571 may be measured and used to control the rate at the desired level by adjusting the flow rate through valve 573 or valve 571. Carbon dioxide is automatically fed into the column through pressure regulator 518 at whatever rate is needed to maintain the column at the desired pressure. The rate at which carbon dioxide is fed into the column equals the rate at which it is withdrawn from the column dissolved in the spray mixture plus the rate at which it is withdrawn from the column with the separated solvent. The solvent is condensed from the depressurized carbon dioxide phase that passes through valve 573 by expansion cooling and by flowing through optional condenser 574. The condensed solvent is collected in receiver 575 and the carbon dioxide is vented through vent 576. The spray mixture thus formed, being the solvent-borne composition phase with a portion of the solvent separated and carbon dioxide dissolved to the solubility limit, which corresponds to the desired concentration for spraying, is withdrawn from column 550 whenever optional air-driven pump 552 is activated by operation of spray gun 560. Pump 552 pressurizes the spray mixture, if desired, to a higher spray pressure. Optional accumulator 555 dampens pressure fluctuations. It is filled with compressed nitrogen from nitrogen cylinder 557 through isolation valve 556. Heater 559 heats the spray mixture to the desired spray temperature, if that is higher than the temperature in column 550. The spray mixture may also be cooled to a lower spray temperature by using a cooler. Increasing the spray mixture pressure to above the solubility pressure compensates for pressure drop that occurs as the spray mixture flows through the equipment and lines to the spray gun, so that the carbon dioxide remains completely dissolved until it is sprayed. Increasing the pressure is necessary whenever the spray mixture is heated in heater 559 to a higher temperature in order to compensate for lower carbon dioxide solubility. Column 550 is preferably thermostatted by suitable means previously described to maintain constant separation temperature. The spray line to spray gun 560 and the spray gun itself are also preferably thermostatted to maintain constant spray temperature if spraying is periodic and for startup. The preferred method is to heat trace the equipment, lines, and spray gun by using a thermostatted circulating heat transfer fluid, such as propylene glycol in water. If column 550 and spray gun 560 operate at the same temperature, then the same thermostatting system may be used. The equipment preferably is insulated. If desired, the design may be modified for two-stage separation by using two columns in series.

To operate the apparatus, the carbon dioxide and solvent-borne composition feed systems are first primed and air is purged from column 550 and the spray line by procedures analogous to those previously described. Column 550 is thermostatted to the desired separation temperature, such as 40° Celsius, and the spray line and spray gun 560 are thermostatted to the desired spray temperature, such as 60° Celsius. Heater 517 is adjusted to the separation temperature. Heater 537 is adjusted to the desired temperature, such as 40° Celsius or higher, for spraying solvent-borne composition into column 550. Heater 559 is adjusted to the desired spray temperature. Pressure regulator 518 is adjusted to give the desired carbon dioxide pressure in column 550, such as 1200 psig, and pump 514 is adjusted to a higher pressure. The column is then filled with carbon dioxide, with valves 571 and 546 closed. Pump 534 is adjusted to give the desired pressure, such as 1800 psig, for spraying the solvent-borne composition into column 550. Valve 546 is then opened and solvent-borne composition is sprayed into the column until the desired liquid level is obtained and controller 507 closes valve 546. The spray line to the spray gun is then filled with spray mixture from column 550. The spray mixture is then sprayed at a constant rate to purge the system while pressure reduction valve 573 is adjusted to give the flow rate of carbon dioxide phase through valve 571 required to give the desired rate of solvent removal from column 550, such as measured by the rate at which solvent accumulates in receiver 575. After the solvent removal rate is adjusted, the spray gun is turned off and the apparatus is ready for on-demand spraying.

Activation of spray gun 560 causes pump 552 to activate to maintain constant spray pressure. Spray mixture withdrawn from column 550 by pump 552 causes the liquid level to drop below the set point. This causes controller 507 to open valves 546 and 571 to spray solvent-borne composition into the column and to withdraw carbon dioxide phase with dissolved solvent from the column. Flow through valve 546 activates pump 534 to supply solvent-borne composition from supply 530. As carbon dioxide is withdrawn from column 550, pressure regulator 518 supplies carbon dioxide from pump 514 and supply 510 to the column at whatever rate is necessary to maintain the desired pressure in the column.

While preferred forms of the present invention have been described, it should be apparent to those skilled in the art that methods and apparatus may be employed that are different from those shown without departing from the spirit and scope thereof.

EXAMPLE 1

A solvent-borne composition that gives an acrylic coating was prepared at a transportable viscosity of 197 centipoise. The composition was prepared from Rohm & Haas Acryloid TM AT-954 resin, which contains nonvolatile acrylic polymer in methyl amyl ketone solvent, and American Cyanamid Cymel TM 323 resin, which is a cross-linking agent that contains nonvolatile melamine polymer in isobutanol solvent inhibitor. The solvent blend contained ethyl 3-ethoxypropionate (EEP) and methyl ethyl ketone, and additional methyl amyl ketone and isobutanol. The phase diagram for this system is given in FIG. 5.

The solvent-borne composition contained 65.85% nonvolatile materials fraction and 34.15% solvent fraction by weight (point A). The polymer fraction had the following composition:

| | | |
|---|---|---|
| acrylic polymer | 8,925.0 g | 75.60% |
| melamine polymer | 2,880.0 g | 24.40% |
| Total | 11,805.0 g | 100.00% |

The solvent fraction had a wide range of relative evaporation rates (RER) (butyl acetate = 100 RER) and the following composition:

| Solvent | Grams | Wt. % | RER |
|---|---|---|---|
| methyl ethyl ketone | 747.0 g | 12.20% | 631 |
| isobutanol | 1,235.0 g | 20.17% | 74 |
| methyl amyl ketone | 2,701.0 g | 44.11% | 40 |
| EEP | 1,440.0 g | 23.52% | 11 |
| Total | 6,123.0 g | 100.00% | |

To be applied by a conventional air spray gun, this coating formulation would be diluted to a viscosity of about 80 centipoise, which would increase the solvent fraction to about 39%.

The solvent-borne composition was sprayed with reduced emission of solvent by using the batch method and apparatus previously described (FIG. 10). The circulation loop and accumulator 49 were filled by manually metering in 2077 grams of solvent-borne composition and 1733 grams of carbon dioxide at room temperature and a pressure of 1200 psig to form the desired precursor liquid spray mixture having 45.5% carbon dioxide (Point C). Pump 65 circulated and mixed the material.

To separate the desired portion of solvent, a separation pressure of 1200 psig was established using regulator 81. The separation was done at room temperature (25° Celsius). The precursor liquid spray mixture was a two-phase mixture having two liquid phases. Solvent was mass transferred from the polymer-rich liquid phase to the carbon dioxide-rich liquid phase as the mixture reached equilibrium. The carbon dioxide solubility limit was about 35% (Point B). The precursor liquid spray mixture (Point C) had the following overall composition:

| | | |
|---|---|---|
| AT-954 polymer | 1,033.9 g | 27.13% |
| Cymel 323 polymer | 333.6 g | 8.76% |
| methyl amyl ketone | 313.0 g | 8.21% |
| EEP | 166.8 g | 4.38% |
| isobutanol | 143.1 g | 3.76% |
| methyl ethyl ketone | 86.6 g | 2.27% |
| Subtotal | 2,077.0 g | 54.51% |
| carbon dioxide | 1,733.0 g | 45.49% |
| Total | 3,810.0 g | 100.00% |

After the phases were well mixed, pump 67 was turned off and the two liquid phases were allowed to settle and physically separate. Accumulator 96 was then pressurized to 1200 psig by regulator 91, which placed the piston in the fully closed position. The carbon dioxide-rich top liquid layer (Point E) with extracted solvent was withdrawn from accumulator 49 through slight glass 50 into accumulator 96 at constant pressure. The mixing and separating sequence was repeated to remove the relatively small amount of carbon dioxide-rich phase trapped elsewhere in the circulation loop. The carbon dioxide-rich phase was then depressurized and the desired amount of 316 grams of extracted solvent was recovered in cold trap 73. About 1032 grams of carbon dioxide were vented. The extracted solvent contained a negligible amount of polymer. The composition of the separated solvent was measured by gas chromatograph, which gave the following amounts:

| | | |
|---|---|---|
| methyl amyl ketone | 158.9 g | 11.79% |
| EEP | 60.7 g | 4.50% |
| isobutanol | 61.3 g | 4.55% |
| methyl ethyl ketone | 35.1 g | 2.60% |
| Subtotal | 316.0 g | 23.44% |
| carbon dioxide | 1032.0 g | 76.56% |
| Total | 1348.0 g | 100.00% |

The liquid spray mixture (Point D) thus formed had the following composition:

-continued

| | | |
|---|---|---|
| AT-954 | 1,033.9 g | 42.00% |
| Cymel 323 polymer | 333.6 g | 13.55% |
| methyl amyl ketone | 154.1 g | 6.26% |
| EEP | 106.1 g | 4.31% |
| isobutanol | 81.8 g | 3.32% |
| methyl ethyl ketone | 51.5 g | 2.09% |
| Subtotal | 1,761.0 g | 71.53% |
| carbon dioxide | 701.0 g | 28.47% |
| Total | 2,462.0 g | 100.00% |

The solvent level on a carbon dioxide-free basis was therefore decreased from 34.15% in the solvent-borne composition (Point A) to 22.34% in the liquid spray mixture (Point G). Of the initial 709.5 grams of solvent in the solvent-borne composition, 316 grams of solvent were separated by extraction. Therefore, the liquid spray mixture thus formed had 44.5% less solvent content than the solvent-borne composition. Therefore, solvent emissions from the spray were reduced by the same amount, for an equal amount of solids sprayed. This corresponded to a 55.0% reduction in solvent emissions from the aforementioned solvent-borne composition that has been further diluted to reduce its viscosity to a level at which it can be sprayed by an air spray gun.

The liquid spray mixture with reduced solvent content thus formed was sprayed by turning on pump 65 and heaters 56 and 67 to obtain the desired spray temperature of 52° Celsius. The pressure was increased to the desired spray pressure of 1700 psig by increasing pressure supplied to accumulator 49 by regulator 81, which held the spray pressure constant as material was sprayed. At these conditions, the liquid spray mixture was a single-phase clear solution and the carbon dioxide was a supercritical fluid diluent.

The spray mixture was sprayed using Binks spray tip #9-0950, which has a 9-mil orifice size, a 50-degree spray angle rating, and an 8-inch fan width rating. A Nordson A7A automatics spray gun was used. The decompressive spray was a feathered parabolic spray fan with a width of about 12 inches.

Coatings were spray applied to Bonderite TM 37 test panels by using a Spraymation model #310540 Automatic Test Panel Spray Unit. Test panels were sprayed to various thickness, flashed for several minutes, and baked vertically at a temperature of 125° Celsius for at least forty minutes.

Coating gloss was measured using a Macbeth TM Novo-Gloss Glossmeter. Distinctness of image (DOI) was measured using a model #300 Distinctness of Image Meter (Mechanical Design and Engineering Company, Burton, Mich.) and a model #1792 Distinctness or Reflected Image Meter (ATI Systems, Madison Heights, Mich.). The coatings had the following properties:

| Coating Thickness | 20-Degree Gloss | MDEC DOI | ATI DOI |
|---|---|---|---|
| 0.9 mil | 75% | 70% | 28% |
| 1.0 mil | 78% | 70% | 35% |
| 1.1 mil | 84% | 75% | 38% |
| 1.3 mil | 88% | 75% | 41% |
| 1.4 mil | 88% | 80% | 48% |
| 1.5 mil | 89% | 80% | 49% |
| 1.7 mil | 91% | 85% | 55% |
| 2.1 mil | 91% | 85% | 53% |

The polymeric coatings were clear and had good appearance. They were very smooth with high gloss and good distinctness of image. They were free of haze and bubbles and did not run or sag or have solvent popping.

The solvent blends of the solvent-borne composition (SBC), the extracted solvent (ES), and the liquid spray mixture (LSP) are given below, in order of relative evaporation rate (RER):

| Solvent | SBC | ES | LSP | RER |
|---|---|---|---|---|
| methyl ethyl ketone | 12.2% | 11.1% | 13.1% | 631 |
| isobutanol | 20.2% | 19.4% | 20.8% | 74 |
| methyl amyl ketone | 44.1% | 50.3% | 39.1% | 40 |
| EEP | 23.5% | 19.2% | 27.0% | 11 |
| Total | 100.0% | 100.0% | 100.0% | |

The solvent profile of the liquid spray mixture is largely the same as the solvent profile of the solvent-borne composition. Therefore, coating performance has not been significantly altered by separating the solvent.

For comparison, the solvent-borne composition was sprayed at the same conditions but without separating solvent. The spray conditions were 28% carbon dioxide, a spray temperature of 52° Celsius, and a spray pressure of 1700 psig. The spray was a feathered parabolic decompressive spray as before. Coatings were sprayed in the same manner. These coatings had the following properties:

| Coating Thickness | 20-Degree Gloss | MDEC DOI | ATI DOI |
|---|---|---|---|
| 0.9 mil | 73% | 70% | 30% |
| 1.1 mil | 82% | 75% | 40% |
| 1.2 mil | 85% | 75% | 42% |
| 1.5 mil | 81% | 70% | 37% |
| 1.6 mil | 86% | 75% | 42% |
| 1.7 mil | 87% | 75% | 46% |
| 2.0 mil | 88% | 75% | 46% |

These coatings sprayed with no solvent separated had generally poorer appearance than those sprayed with 44.5% of the solvent separated. The gloss and distinctness of image readings were generally several percentage points lower.

For another comparison, a coating concentrate with about the same solids level (78.7%) as the solvent-borne composition after the solvent was separated (77.7%), and which was formulated for spraying with supercritical carbon dioxide, was sprayed at the same conditions of 28% carbon dioxide, 52° Celsius, and 1700 psig. The coating concentrate had a high viscosity of about 3000 centipoise (23° Celsius), which indicates that removal of the solvent from the solvent-borne composition increased the viscosity, on a carbon dioxide-free basis, from the low level of 197 centipoise at which it was prepared to a high level above 2500 centipoise. The coating concentrate had the following component composition, where SILWET/L7602 is a surfactant:

| | | |
|---|---|---|
| AT-954 polymer | 8,925.0 g | 59.50% |
| Cymel 323 polymer | 2,880.0 g | 19.20% |
| methyl amyl ketone | 1,575.0 g | 10.50% |
| EEP | 840.0 g | 5.60% |
| isobutanol | 720.0 g | 4.80% |
| SILWET L7602 | 60.0 g | 0.40% |
| Total | 15,000.0 g | 100.00% |

The spray was a feathered parabolic decompressive spray as before. The coatings sprayed in the same manner using the coating concentrate had the following properties:

| Coating Thickness | 20-Degree Gloss | MDEC DOI | ATI DOI |
|---|---|---|---|
| 1.0 mil | 78% | 70% | 33% |
| 1.5 mil | 89% | 80% | 52% |
| 1.6 mil | 89% | 80% | 52% |
| 2.0 mil | 92% | 85% | 56% |
| 2.4 mil | 89% | 85% | 65% |

The coatings sprayed with the coating concentrate had generally equal performance to the coatings sprayed with the solvent-borne composition after a portion of the solvent was separated prior to spraying to produce about the same high solids level.

EXAMPLE 2

A solvent-borne composition that produces an acrylic coating was prepared at a viscosity of 460 centipoise by using the same polymers as in Example 1 and mixing the resins with diluent solvents ethyl 3-ethoxypropionate (EEP) and methyl amyl ketone, and with Union Carbide SILWET/L7602 surfactant. This produced a solvent-borne composition containing 71.19% nonvolatile materials fraction and 28.81% solvent fraction by weight, with the following component composition:

| | | |
|---|---|---|
| acrylic polymer | 8,925.0 g | 53.55% |
| melamine polymer | 2,880.0 g | 17.28% |
| methyl amyl ketone | 3,242.0 g | 19.45% |
| EEP | 840.0 g | 5.04% |
| isobutanol | 720.0 g | 4.32% |
| SILWET L7602 | 60.0 g | 0.36% |
| Total | 16,667.0 g | 100.00% |

The solvent fraction had the following composition and relative evaporation rates:

| Solvent | Grams | Wt. % | RER |
|---|---|---|---|
| isobutanol | 720.0 g | 14.99% | 74 |
| methyl amyl ketone | 3,242.0 g | 67.52% | 40 |
| EEP | 840.0 g | 17.49% | 11 |
| Total | 4,802.0 g | 100.0% | |

The solvent-borne composition thus prepared was sprayed with reduced emission of solvent by using the same apparatus and procedure as in Example 1, except that the solvent-borne composition and carbon dioxide were fed to the apparatus concurrently by using the control system to automatically obtained the desired proportion. The circulation loop and accumulator 49 were filled with 2272 grams of solvent-borne composition and 1477 grams of carbon dioxide, which formed the desired precursor liquid spray mixture having 39.4% percent carbon dioxide.

Figure 6:
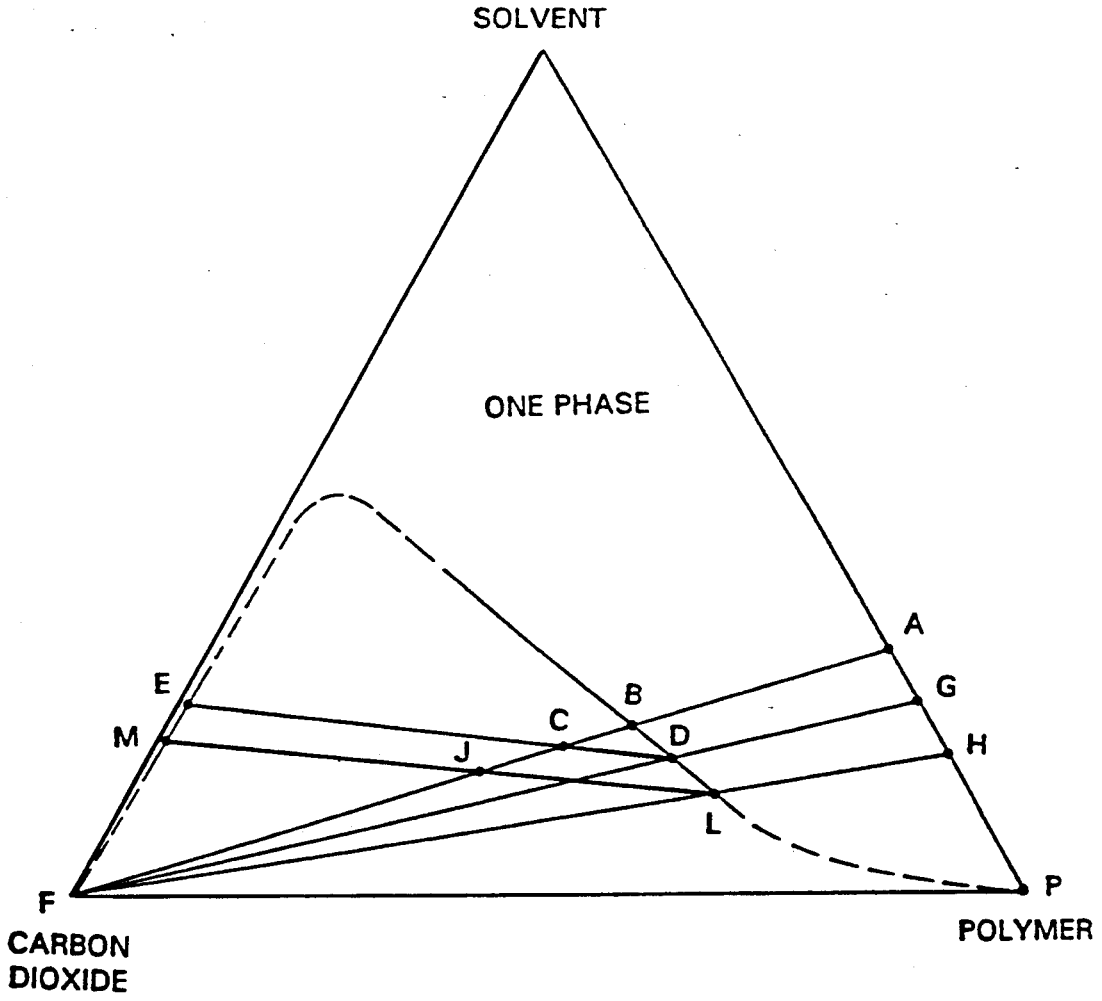
FIG. 6 is a triangular composition phase diagram for another acrylic polymer solvent-borne coating composition showing measured tie lines and composition points used to separate solvent using two different amounts of compressed carbon dioxide at a pressure of 1600 psig and a temperature of about 55° Celsius.

To separate the desired portion of solvent, a separation pressure of about 1600 psig was established at a temperature of about 55° Celsius. The phase diagram is shown in FIG. 6. The precursor liquid spray mixture (Point C) was a two-phase mixture having two liquid phases and the following overall composition:

| | | |
|---|---|---|
| acrylic polymer | 1,216.7 g | 32.45% |
| melamine polymer | 392.6 g | 10.47% |
| methyl amyl ketone | 441.9 g | 11.79% |
| EEP | 114.5 g | 3.05% |
| isobutanol | 98.1 g | 2.62% |
| SILWET L7602 | 8.2 g | 0.22% |
| Subtotal | 2,272.0 g | 60.60% |
| carbon dioxide | 1,477.0 g | 39.40% |
| Total | 3,749.0 g | 100.00% |

After the phases were well mixed, the two liquid phases were allowed to settle and physically separate. Accumulator 96 was then pressurized to 1600 psig and the carbon dioxide-rich top liquid layer (Point E) with extracted solvent was withdrawn from accumulator 49 into accumulator 96. The mixture and separation sequence was then repeated.

The separated carbon dioxide-rich phase (Point E) was then depressurized and 185.6 grams of extracted solvent was recovered in the cold trap. About 625 grams of carbon dioxide were vented. The separated solvent had the following composition:

| | | |
|---|---|---|
| methyl amyl ketone | 131.0 g | 16.17% |
| EEP | 28.8 g | 3.55% |
| isobutanol | 25.8 g | 3.18% |
| Subtotal | 185.6 g | 22.90% |
| carbon dioxide | 625.0 g | 77.10% |
| Total | 810.6 g | 100.00% |

The liquid spray mixture (Point D) thus formed had the following composition:

| | | |
|---|---|---|
| acrylic polymer | 1,216.7 g | 41.40% |
| melamine polymer | 392.6 g | 13.36% |
| methyl amyl ketone | 310.9 g | 10.58% |
| EEP | 85.7 g | 2.92% |
| isobutanol | 72.3 g | 2.46% |
| SILWET L7602 | 8.2 g | 0.28% |
| Subtotal | 2,086.4 g | 71.00% |
| carbon dioxide | 852.0 g | 29.00% |
| Total | 2,938.4 g | 100.00% |

The solvent level on a carbon dioxide-free basis was decreased from 28.8% in the solvent-borne composition (Point A) to 22.5% in the liquid spray mixture (Point G). Of the initial 654.5 grams of solvent in the solvent-borne composition, 185.6 grams of solvent were separated by extraction. Therefore, the liquid spray mixture had 28.4% less solvent than the solvent-borne composition; hence solvent emissions were reduced by this amount.

The liquid spray mixture with reduced solvent content thus formed was sprayed at a temperature of 55° Celsius and a pressure of 1700 psig, which gave a single-phase clear solution. The carbon dioxide was a supercritical fluid diluent.

The spray mixture was sprayed using the same spray gun, spray tip, test panels, and procedure as in Example 1. The decompressive spray was a feathered parabolic spray about 12 inches wide. The baked coatings had the following properties:

| Coating Thickness | 20-Degree Gloss | MDEC DOI | ATI DOI |
|---|---|---|---|
| 1.6 mil | 87% | 80% | 46% |
| 2.2 mil | 90% | 85% | 55% |

-continued

| Coating Thickness | 20-Degree Gloss | MDEC DOI | ATI DOI |
|---|---|---|---|
| 2.6 mil | 91% | 85% | 63% |

The polymeric coatings were clear, smooth, glossy, had good appearance, and did not run or sag.

For comparison, the solvent-borne composition was sprayed at the same conditions but without solvent removal. The spray was a feathered parabolic spray as before. The coatings had the following properties:

| Coating Thickness | 20-Degree Gloss | MDEC DOI | ATI DOI |
|---|---|---|---|
| 1.4 mil | 63% | 60% | 25% |
| 1.7 mil | 71% | 60% | 28% |
| 2.2 mil | 88% | 80% | 54% |
| 2.5 mil | 88% | 85% | 62% |

The coatings sprayed with carbon dioxide but with no solvent removed had generally poorer appearance than those sprayed with 28.4% of the solvent separated. The gloss and distinctness of image readings were generally lower and the coatings suffered from sag caused by the higher content of slow solvent.

EXAMPLE 3

A solvent-borne composition that produces an acrylic coating was prepared at a transportable viscosity of 210 centipoise by using the same polymers, formulation, and solids level as in Example 2, but with acetone replacing the diluent methyl amyl ketone solvent. This produced a solvent-borne composition containing 71.19% nonvolatile materials fraction and 28.81% solvent fraction, with the following composition:

| | | |
|---|---|---|
| acrylic polymer | 8,925.0 g | 53.55% |
| melamine polymer | 2,880.0 g | 17.28% |
| acetone | 1,667.0 g | 10.00% |
| methyl amyl ketone | 1,575.0 g | 9.45% |
| EEP | 840.0 g | 5.04% |
| isobutanol | 720.0 g | 4.32% |
| SILWET L7602 | 60.0 g | 0.36% |
| Total | 16,667.0 g | 100.00% |

The solvent fraction had the following composition and relative evaporation rates:

| Solvent | Grams | Wt. % | RER |
|---|---|---|---|
| acetone | 1,667.0 g | 34.72% | 1440 |
| isobutanol | 720.0 g | 14.99% | 74 |
| methyl amyl ketone | 1,575.0 g | 32.80% | 40 |
| EEP | 840.0 g | 17.49% | 11 |
| Total | 4,802.0 g | 100.00% | |

The solvent-borne composition thus prepared was sprayed with reduced emission of solvent by using the same apparatus and procedure as in Example 2. The apparatus was filled with 1857 grams of solvent-borne composition and 1820 grams of carbon dioxide, which formed a precursor liquid spray mixture having 49.5% carbon dioxide, in order to separate more solvent than in Example 2.

To separate solvent, a separation pressure of about 1600 psig was established with a temperature of about 55° Celsius. The phase diagram is shown in FIG. 6. The precursor liquid spray mixture (Point J) was a two-phase mixture having two liquid phases, which had the following overall composition:

| | | |
|---|---|---|
| acrylic polymer | 994.4 g | 27.04% |
| melamine polymer | 320.9 g | 8.73% |
| acetone | 185.7 g | 5.05 |
| methyl amyl ketone | 175.5 g | 4.77% |
| EEP | 93.6 g | 2.55% |
| isobutanol | 80.2 g | 2.18% |
| SILWET L7602 | 6.7 g | 0.18% |
| Subtotal | 1,857.0 g | 50.50% |
| carbon dioxide | 1,820.0 g | 49.50% |
| Total | 3,677.0 g | 100.00% |

After the two liquid phases were well mixed, they were allowed to settle and physically separate. The carbon dioxide-rich top liquid layer (Point M) with extracted solvent was then removed and depressurized, with 280 grams of extracted solvent recovered and about 1237 grams of carbon dioxide vented. The separated solvent had the following composition:

| | | |
|---|---|---|
| acetone | 61.1 g | 4.03% |
| methyl amyl ketone | 120.1 g | 7.92% |
| EEP | 47.6 g | 3.14% |
| isobutanol | 51.2 g | 3.37% |
| Subtotal | 280.0 g | 18.46% |
| carbon dioxide | 1237.0 g | 81.54% |
| Total | 1517.0 g | 100.00% |

The liquid spray mixture (Point L) thus formed had the following composition:

| | | |
|---|---|---|
| acrylic polymer | 994.4 g | 46.04% |
| melamine polymer | 320.9 g | 14.86% |
| acetone | 124.6 g | 5.77% |
| methyl amyl ketone | 55.4 g | 2.56% |
| EEP | 46.0 g | 2.13% |
| isobutanol | 29.0 g | 1.34% |
| SILWET L7602 | 6.7 g | 0.31% |
| Subtotal | 1,577.0 g | 73.01% |
| carbon dioxide | 583.0 g | 26.99% |
| Total | 2,160.0 g | 100.00% |

Figure 7:
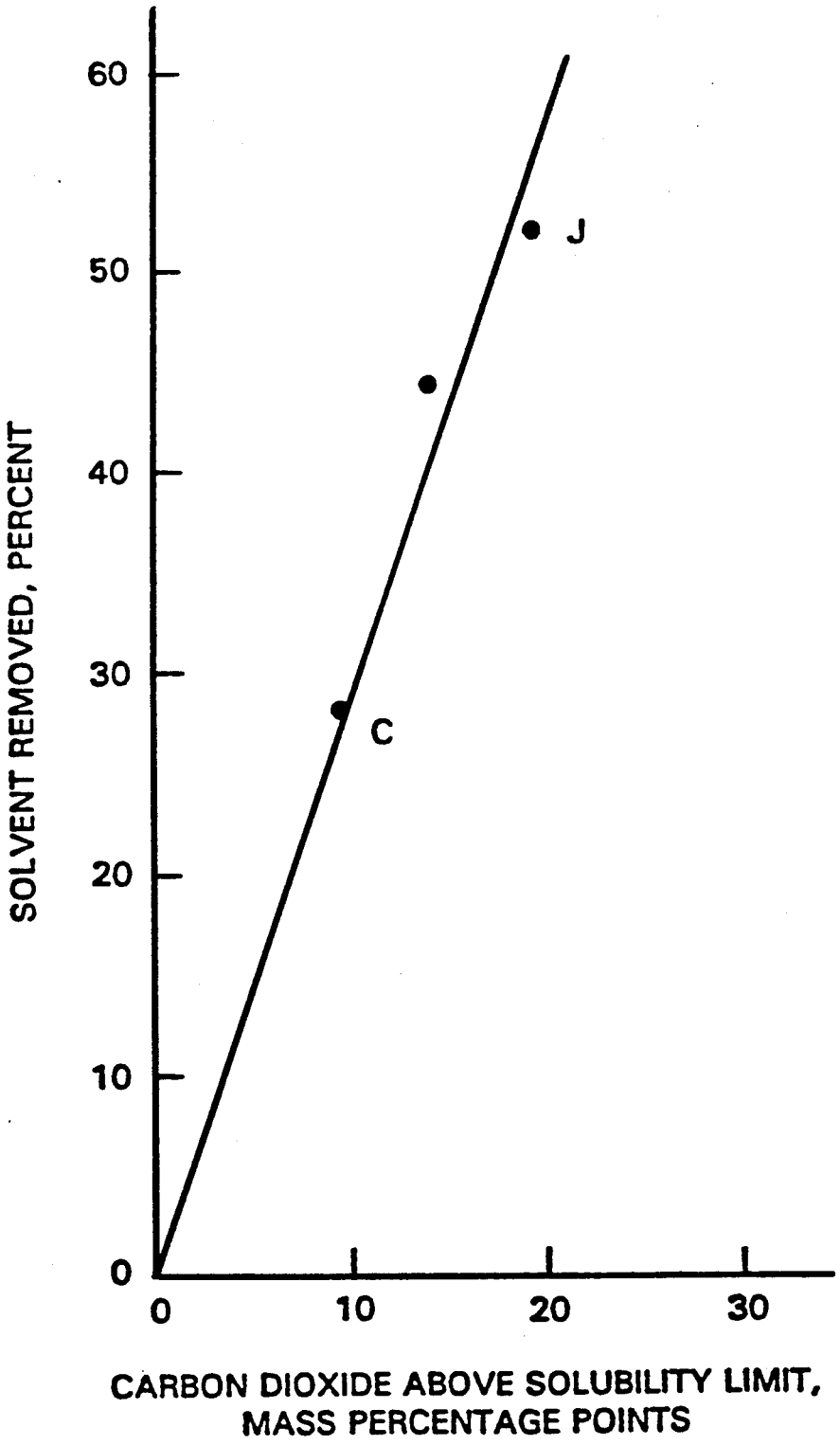
FIG. 7 is a diagram showing how the percentage of solvent separated from the system in FIG. 6 was proportional to the amount of compressed carbon dioxide above the solubility limit.

The solvent level, on a carbon dioxide-free basis, was decreased from 28.8% in the solvent-borne composition (Point A) to a low level of 16.2% in the liquid spray mixture (Point H). Of the initial 535 grams of solvent in the solvent-borne composition, 280 grams of solvent were separated by extraction. Therefore, the liquid spray mixture thus formed had 52.3 percent less solvent content than the solvent-borne composition; hence solvent emissions were reduced by this amount. FIG. 7 shows how the percentage of solvent separated from the solvent-borne composition is proportional to the amount of carbon dioxide used that is above the solubility limit.

The liquid spray mixture with reduced solvent content thus formed was sprayed at a temperature of 55° Celsius and a pressure of 1600 psig, which gave a single-phase clear solution. The spray mixture contained 27.0% carbon dioxide but only 11.8% solvent. It was sprayed using the same spray gun, spray tip, test panels, and procedure as in Example 2. The decompressive spray was a feathered parabolic spray about 12 inches wide. Coating were sprayed that had the following properties:

| Coating Thickness | 20-Degree Gloss | MDEC DOI | ATI DOI |
|---|---|---|---|
| 0.9 mil | 78% | 65% | 32% |
| 1.3 mil | 84% | 75% | 45% |
| 1.6 mil | 80% | 70% | 36% |
| 2.2 mil | 88% | 80% | 53% |

The polymeric coating were clear, smooth, glossy, and did not run or sag. Because the formulation contained a large proportion of very fast evaporating acetone, which evaporates in the spray, the coating was deposited at even higher solids level (91% ) and high viscosity, which caused the coatings to have some orange peel. Therefore either the solvent level could have been further reduced, by omitting some or all of the acetone, or coating performance could have been improved by replacing the acetone with a slow evaporating solvent, to improve coating flow out.

For comparison, the solvent-borne composition was sprayed at the same conditions but without solvent removal. The coating had the following properties:

| Coating Thickness | 20-Degree Gloss | MDEC DOI | ATI DOI |
|---|---|---|---|
| 1.1 mil | 76% | 65% | 32% |
| 1.4 mil | 87% | 80% | 52% |
| 1.7 mil | 85% | 80% | 46% |
| 1.9 mil | 88% | 85% | 60% |
| 2.2 mil | 83% | 85% | 56% |

Surprisingly, these coatings sprayed with carbon dioxide but with no solvent separated had only somewhat better appearance than those sprayed with 52.3% of the solvent separated.

What is claimed is:

1. A method for spraying a solvent-borne composition with reduced emission of organic solvent while maintaining low viscosity, said solvent-borne composition comprising:

(i) a nonvolatile materials fraction capable of being sprayed as a liquid solution or dispersion; and (ii) a solvent fraction containing at least one organic solvent in which said nonvolatile materials fraction is at least partially soluble or dispersible and at least in an amount which is sufficient to render the viscosity of said solvent-borne composition having a viscosity of less than about 200 centipoise, (a) forming a precursor liquid spray mixture in a closed system, said precursor liquid spray mixture comprising said solvent-borne composition and, in addition, (iii) at least one compressed fluid under sufficient pressure and at least in an amount which when added to said solvent-borne composition is sufficient to maintain said precursor liquid spray mixture transportable after at least a portion of said solvent fraction is separated in step (b), said compressed fluid being a gas at standard conditions of 0° Celsius temperature and one atmosphere pressure (STP);

(b) separating at least a portion of solvent fraction (ii) from said precursor liquid spray mixture to form a liquid spray mixture having less organic solvent than said precursor liquid spray mixture, and then (c) passing the thusly formed liquid spray mixture under pressure through an orifice to form a spray.

2. The method of claim 1, wherein the transportable viscosity of the liquid spray mixture is maintained at less than about 200 centipoise.

3. The method of claim 1, wherein said compressed fluid is selected from the group consisting of carbon dioxide, nitrous oxide, ammonia, xenon, ethane, ethylene, propane, propylene, butane, isobutane, chlorotrifluoromethane, and monofluoromethane.

4. The method of claim 1, wherein said compressed fluid is a supercritical fluid at the temperature and pressure at which said liquid spray mixture is sprayed.

5. The method of claim 1, wherein the solvent fraction (b) is separated from the precursor liquid spray mixture by extraction, supercritical fluid extraction, gas stripping, or supercritical fluid stripping.

6. The method of claim 1, wherein said compressed fluid (iii) is present in said precursor liquid spray mixture in sufficient amount and under sufficient presure that said precursor liquid spray mixture comprises at least two fluid phases consisting of at least a liquid nonvolatile materials-rich phase and a liquid compressed fluid-rich phase, and said portion of solvent fraction (ii) is separated by mass transfer of at least a portion of solvent fraction (ii) from said liquid nonvolatile materials-rich phase into said liquid compressed fluid-rich phase and then at least a portion of said liquid compressed fluid-rich phase is physically separated from said precursor liquid spray mixture to form said liquid spray mixture having less organic solvent.

7. The method of claim 1, wherein said compressed fluid is present in said precursor liquid spray mixture in an amount above about 15 weight percent based upon the total weight of (i), (ii), and (iii).

8. The method of claim 1, wherein at least 20 percent by weight of solvent fraction (ii) is separated from the precursor liquid spray mixture.

9. The method of claim 1, wherein said solvent-borne composition is a solvent-borne polymeric composition wherein said nonvolatile materials fraction (i) contains at least one polymeric compound.

10. The method of claim 9, wherein said solvent-borne polymeric composition comprises a solvent-borne coating composition that contains at least one polymeric compound capable of forming a coating on a substrate.

11. The method of claim 9, wherein the solvent fraction (ii) is separated by contacting said precursor liquid spray mixture with a microporous membrane and passing at least a portion of solvent fraction (ii) through said membrane.

12. The method of claim 11, wherein said polymeric compound has an average molecular weight above about 10,000.

13. The method of claim 11, wherein said microporous membrane is a ceramic membrane with an average pore size of about 40 Angstroms to about 200 Angstroms with a porous support.

14. A method of spraying a solvent-borne additives composition to a polymeric substrate prior to extrusion, filming, molding, or processing of the polymeric substrate with reduced emission of organic solvent while maintaining low viscosity, said solvent-borne additives composition comprising:

(i) a dispersed solid additives fraction containing at least one dispersible solid additive capable of being sprayed as a dispersion;

(ii) a polymer fraction containing at least one polymeric compound; and (iii) a solvent fraction containing at least one organic solvent in which said at least one polymeric compound is at least partially soluble and at least in an amount which is sufficient to render the viscosity of said solvent-borne additives composition to less than about 200 centipoise, which method comprises:

(a) forming a precursor liquid spray mixture in a closed system, said precursor liquid spray mixture comprising said solvent-borne additives composition and, in addition, (iv) at least one compressed fluid under sufficient pressure and at least in an amount which when added to said solvent-borne additives composition is sufficient to maintain said precursor liquid spray mixture transportable after at least a portion of said solvent fraction is separated in step (b), said compressed fluid being a gas at standard conditions of 0° Celsius temperature and one atmosphere pressure (STP);

(b) separating at least a portion of solvent fraction (iii) from said precursor liquid spray mixture to form a liquid spray mixture having less organic solvent than said precursor liquid spray mixture, and then (c) passing the thusly formed liquid spray mixture under pressure through an orifice to form a spray and directing said spray at a polymeric substrate to deposit said additives thereon.

15. The method of claim 14, wherein said compressed fluid is selected from the group consisting of carbon dioxide, nitrous oxide, ammonia, xenon, ethane, ethylene, propane, propylene, butane, isobutane, chlorotrifluoromethane, and monofluoromethane.

16. The method of claim 14, wherein the solvent fraction (b) is separated from the precursor liquid spray mixture by extraction, supercritical fluid extraction, gas stripping, supercritical fluid stripping, or by passing at least a portion of solvent fraction (ii) through a microporous membrane.

17. The method of claim 14, wherein said compressed fluid (iv) is present in said precursor liquid spray mixture in sufficient amount and under sufficient pressure that said precursor liquid spray mixture comprises at least two fluid phases consisting of at least a liquid additives-rich phase and a liquid compressed fluid-rich phase, and said portion of solvent fraction (iii) is separated by mass transfer of at least a portion of solvent fraction (iii) from said liquid additives-rich phase into said liquid compressed fluid-rich phase and then at least a portion of said liquid compressed fluid-rich phase is physically separated from said precursor liquid spray mixture to form said liquid spray mixture having less organic solvent.

18. The method of claim 14, wherein the solvent fraction (c) is substantially separated from the precursor liquid spray mixture.

19. The method of claim 14, wherein the polymeric substrate is selected from the group consisting of polyethylenes, polypropylenes, ethylene-propylene interpolymers, nylons, polyesters, acrylonitrile-butadiene-styrene terpolymers, cellulose acetates, polycarbonates, polymethylmethacrylates, polystyrenes, polyvinylchlorides, and mixtures thereof.

* * * * *